US009557673B2

(12) United States Patent
Matsumura

(10) Patent No.: US 9,557,673 B2
(45) Date of Patent: Jan. 31, 2017

(54) ELECTROSTATIC CHARGE IMAGE DEVELOPING TONER, ELECTROSTATIC CHARGE IMAGE DEVELOPER, AND TONER CARTRIDGE

(71) Applicant: FUJI XEROX CO., LTD., Tokyo (JP)

(72) Inventor: Yasuo Matsumura, Kanagawa (JP)

(73) Assignee: FUJI XEROX CO., LTD, Tokyo (JP)

( * ) Notice: Subject to any disclaimer, the term of this patent is extended or adjusted under 35 U.S.C. 154(b) by 0 days.

(21) Appl. No.: 14/801,689

(22) Filed: Jul. 16, 2015

(65) Prior Publication Data

US 2016/0238959 A1 Aug. 18, 2016

(30) Foreign Application Priority Data

Feb. 16, 2015 (JP) ..... 2015-028080

(51) Int. Cl.
*G03G 9/08* (2006.01)
*G03G 9/087* (2006.01)

(52) U.S. Cl.
CPC ..... *G03G 9/08797* (2013.01); *G03G 9/0819* (2013.01); *G03G 9/0821* (2013.01)

(58) Field of Classification Search
CPC ..... G03G 9/08797; G03G 9/0821
USPC ..... 430/111.4
See application file for complete search history.

(56) References Cited

U.S. PATENT DOCUMENTS

| | | | |
|---|---|---|---|
| 2009/0053631 | A1 | 2/2009 | Matsumura |
| 2009/0226834 | A1 | 9/2009 | Matsumura |
| 2010/0047706 | A1 | 2/2010 | Matsumura et al. |
| 2011/0171572 | A1 | 7/2011 | Matsumura et al. |

FOREIGN PATENT DOCUMENTS

| | | | |
|---|---|---|---|
| JP | 2007-310064 | A | 11/2007 |
| JP | 2007-322953 | A | 12/2007 |
| JP | 2009-053318 | A | 3/2009 |
| JP | 2009-109661 | A | 5/2009 |
| JP | 2009-244857 | A | 10/2009 |
| JP | 2010-049065 | A | 3/2010 |
| JP | 2010-134024 | A | 6/2010 |
| JP | 2010-175734 | A | 8/2010 |
| JP | 2011-145333 | A | 7/2011 |

*Primary Examiner* — Mark A Chapman
(74) *Attorney, Agent, or Firm* — Oliff PLC

(57) ABSTRACT

An electrostatic charge image developing toner includes toner particles containing a binder resin and inorganic particles that are present in a state of being embedded into the surfaces of the toner particles and being exposed, and satisfy the following expression: $20° C. \leq T_1 - T_{10}$, wherein $T_1$ represents the temperature at which the viscosity under an applied pressure of 1 MPa becomes $10^4$ Pa·s, and $T_{10}$ represents the temperature at which the viscosity under an applied pressure of 10 MPa becomes $10^4$ Pa·s.

12 Claims, 2 Drawing Sheets

ELECTROSTATIC CHARGE IMAGE DEVELOPING TONER, ELECTROSTATIC CHARGE IMAGE DEVELOPER, AND TONER CARTRIDGE

CROSS-REFERENCE TO RELATED APPLICATIONS

This application is based on and claims priority under 35 USC 119 from Japanese Patent Application No. 2015-028080 filed Feb. 16, 2015.

BACKGROUND

1. Technical Field

The present invention relates to an electrostatic charge image developing toner, an electrostatic charge image developer, and a toner cartridge.

2. Related Art

A method in which image information is visualized through an electrostatic charge image, such as an electrophotographic method, is currently used in various fields. In the electrophotographic method, an electrostatic charge image formed on a photoreceptor by a charging step and an electrostatic charge image forming step is developed with a developer including an electrostatic charge image developing toner, and visualized through a transfer step and a fixing step. Here, a fixing method in which fixing is performed by applying pressure in the fixing step is studied, and a toner which exhibits plasticity behavior with respect to pressure as a toner is attempted.

SUMMARY

According to an aspect of the invention, there is provided an electrostatic charge image developing toner including:

toner particles containing a binder resin and inorganic particles that are present in a state of being embedded into the surfaces of the toner particles and being exposed, and the toner particles satisfy the following expression:

$$20^\circ\ \text{C.} \leq T_1 - T_{10}$$

wherein $T_1$ represents the temperature at which the viscosity under an applied pressure of 1 MPa becomes $10^4$ Pa·s, and $T_{10}$ represents the temperature at which the viscosity under an applied pressure of 10 MPa becomes $10^4$ Pa·s.

BRIEF DESCRIPTION OF THE DRAWINGS

Exemplary embodiments of the present invention will be described in detail based on the following figures, wherein.

DETAILED DESCRIPTION

Figure 1A:
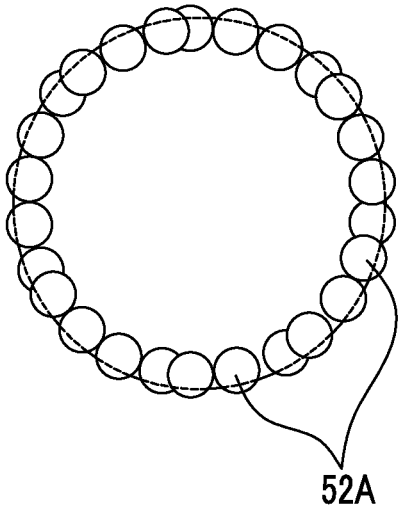
FIG. 1A is a schematic sectional view showing an example of an electrostatic charge image developing toner according to the exemplary embodiment.

Hereinafter, the exemplary embodiment which is an example of the present invention will be described in detail.

Electrostatic Charge Image Developing Toner

An electrostatic charge image developing toner according to the exemplary embodiment (hereinafter, also simply referred to as "toner") has toner particles containing a binder resin and inorganic particles.

In the toner particles, the inorganic particles are present in a state of being embedded into the surface and being exposed. In addition, the toner according to the exemplary embodiment satisfies the following expression (1).

$$20^\circ\ \text{C.} \leq T_1 - T_{10} \qquad \text{Expression (1)}$$

(In the expression (1), $T_1$ represents the temperature at which the viscosity under an applied pressure of 1 MPa becomes $10^4$ Pa·s, and $T_{10}$ represents the temperature at which the viscosity under an applied pressure of 10 MPa becomes $10^4$ Pa·s.)

Moreover, the above-described toner may be toner particles as they are, or may be an externally added toner obtained by further adding an external additive to the toner particles.

According to the exemplary embodiment, excellent pressure fixing performance is exhibited and inclusion of a coarse powder is prevented. The reason why such effects are exhibited is not clear, but is considered to be due to the reasons described below.

The toner satisfying the expression (1) has the difference greater than 20° C. in the temperatures at which the viscosities under applied pressures of 1 MPa and 10 MPa each are the above value, that is, exhibits plasticity behavior with respect to pressure even in a state of not being heated, and exhibits fluidity at ordinary temperature (for example, 20° C.) under a pressure higher than a prescribed pressure. When the toner satisfies the expression (1), resin fluidity required for fixing is obtained even in the use of a simple pressure fixing device, and excellent pressure fixing performance is exhibited. In addition, in the case where a pressure higher than the prescribed pressure is applied to the toner, the toner behaves as a fluid, and in contrast, in the case where a pressure is not applied, the toner behaves as a solid. Therefore, in a developing step, a transfer step, a cleaning step, or the like, which is other than a pressure fixing, in an electrophotographic process or the like, attachment of the toner to the image holding member may be prevented, and thus, reliability may also be ensured.

In addition, reduction in the size of a toner to a diameter of 6 μm or smaller which is not easy in the related art, is realized, due to this, reduction of the amount of toner consumed and formation of a high-resolution image are realized, a high image quality and high reliability are also obtained.

Moreover, although a method of exhibiting plasticity behavior of the toner with respect to the pressure is not particularly limited, for example, a method of using a baroplastic resin described below as a binder resin is exemplified. In the case of preparing toner satisfying the above expression (1) by such a method of using a baroplastic resin or the like, in general, a wet preparation method is employed, after taking out the toner particles from the liquid, a drying treatment is performed. However, in the drying treatment, aggregation of the toner particles occurs to thereby form a coarse powder having a particle diameter greater than that of the toner particles is formed in some cases.

In a case where flow is accompanied in the air heated and dried in the drying step, or in a case where collision between the particles or collision with the instrument wall are accompanied, the formation of such a coarse powder tends to become more frequent. In addition, when a toner having a smaller diameter is prepared for reduction of the amount of toner consumed or formation of a high-resolution image, the formation of the coarse powder tends to become more frequent.

Moreover, there is a method of removing the coarse powder by performing classification or sieving on the coarse powder formed, but in this case, disposal or the like of charged raw materials is needed, and thus, the productivity is inferior. It is required to prevent the formation of a coarse powder without performing classification or sieving.

In addition, a method of reducing the formation of a coarse powder by lowering the heat temperature is also considered, but, it takes a long period of time to dry, and the productivity is also inferior, and thus, it is required that the formation of a coarse powder is prevented even without taking such a method.

In contrast, in the toner according to the exemplary embodiment, the toner particles contain inorganic particles which are present in a state of being embedded into the surface and being exposed. When the inorganic particles are present on the surface, the aggregation of the toner particles is prevented, and the formation of a coarse powder is prevented, and as a result, a toner exhibiting excellent pressure fixing performance and preventing inclusion of coarse powder is provided.

Here, the % by volume of the particles of which the particle diameter measured by COULTER MULTISIZER II (manufactured by Beckman Coulter, Inc.) which is a particle diameter measuring machine becomes 20 μm or greater is used as an indicator of the amount of coarse powder in the toner, and 3% by volume or less, which is comparable to that in a general toner for heat fixing, is preferable.

Inorganic particles which are present in a state of being embedded into the surface of a toner particle and being exposed In the toner according to the exemplary embodiment, the inorganic particles are present in a state of being embedded into the surface of a toner particle and being exposed. Here, "present in a state of being embedded into the surface and being exposed" represents neither an aspect in which a particle is present in a state of being attached loosely to the surface as the inorganic particles externally added after the toner particle preparation, nor an aspect in which the entire part of a particle is embedded in the toner particle as the inorganic particles internally added in the toner particles, and thus, even a part of the particle is not exposed on the surface. That is, "present in a state of being embedded into the surface and being exposed" indicate a state in which a part of a particle is embedded into the surface of the toner particle and the remaining part thereof is exposed from the surface of the toner particle.

The specific confirmation method will be described. When the toner is a toner in which an external additive is not added to the surface thereof, the toner (toner particles) is observed as it is. When the toner is a toner in which an external additive is added to the surface thereof, by performing an ultrasonic treatment (20 KHz, 10 minutes) on the toner in water, the additives such as inorganic particles attached to (separated from) the surface are removed, and then, observation is performed. The surface observation of the toner particles is performed by, for example, a scanning electron microscope (SEM) or the like, and by determining the presence or absence of the inorganic particles exposed, confirmation is performed.

In addition, as an indicator of the presence or absence of the inorganic particles which are present in a state of being embedded into the surface of a toner particle and being exposed and the amount thereof, the BET specific surface area is used. In the toner according to the exemplary embodiment, the lower limit of the BET specific surface area is preferably 0.8 $m^2/g$ or greater, more preferably 0.9 $m^2/g$ or greater, still more preferably 1.0 $m^2/g$ or greater, particularly preferably 1.5 $m^2/g$ or greater. In addition, the upper limit of the BET specific surface area is preferably 5.0 $m^2/g$ or less, more preferably 4.5 $m^2/g$ or less, and still more preferably 4.0 $m^2/g$ or less.

When the BET specific surface area is the above-described lower limit value or greater, the sufficient amount of inorganic particles is present on the toner particle surface, and formation of a coarse powder is prevented. On the other hand, when the BET specific surface area is the above-described upper limit value or less, effects such as an effect capable of preventing an occurrence of deterioration of developing property due to charging failure are obtained.

The method of measuring the BET specific surface area of the toner is performed by a nitrogen substitution method. Specifically, the BET specific surface area is measured by a three-point method using a specific surface area measuring apparatus SA3100 (manufactured by Beckman Coulter, Inc.).

Moreover, in an aspect in which the inorganic particles are present in a state of not being embedded into the surface of a toner particle, that is, present in a state of being attached to the surface by external addition to the toner particles before a drying treatment, formation of coarse powder is unlikely to be prevented. It is considered that the inorganic particles are not favorably dispersed, the inorganic particles are unevenly present, and therefore, aggregation of the toner particles is unlikely to be prevented.

Hereinafter, the toner according to the exemplary embodiment will be described in detail.

In the toner according to the exemplary embodiment, the toner particles contain a binder resin and inorganic particles which are present in a state of being embedded into the surface and being exposed.

Inorganic Particles

Figure 1B:
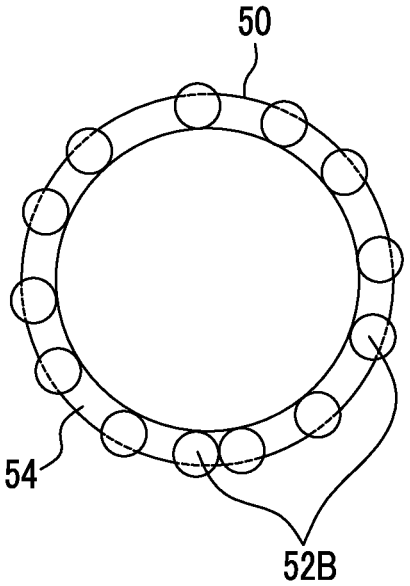
FIG. 1B is a schematic sectional view showing another example of the electrostatic charge image developing toner according to the exemplary embodiment.

In the exemplary embodiment, the inorganic particles are present in a state of being embedded into the surface of a toner particle and being exposed. Moreover, the toner particles may have an aspect in which the toner particles are present in a state in which inorganic particles 52A are embedded into the surface and a part thereof is exposed as shown in FIG. 1A, or the toner particles may have an aspect in which a shell layer 50 including inorganic particles 52B and a resin 54 is formed on the surface, and the inorganic particles 52B are partly exposed to the surface of the shell layer 50 as shown in FIG. 1B. In addition, the entire surface of a toner particle may be coated with the inorganic particles, or a part of the surface may be formed of other materials such as a binder resin.

Achieving Method

A method of producing toner particles such that inorganic particles are present in a state of being embedded into the surface and being exposed will be described. Although the method is not particularly limited, when producing toner particles by a wet method such as an emulsion aggregating method or a dissolution and suspension method, a method in which inorganic particles are added to toner particles in a state in which aggregation of the toner particles is prevented, and thus, the toner particles are separately present, that is, in a state before being taken out from the liquid before a drying treatment, and the inorganic particles are made to be present on the toner particle surface is exemplified.

In the case of using the emulsion aggregating method as a method of preparing a toner, toner particles are obtained by dispersing inorganic particles together with a surfactant or the like using a homogenizer, adding the resultant product in a state of a dispersion at the end of the toner aggregation step, and further heating to coalesce the inorganic particles with the surfaces of the toner particles. In addition, in the case of forming a shell layer on the surface of toner particles as a complex of a resin and inorganic particles, a toner is obtained by adding a mixed dispersion of inorganic particles and resin particles at the end of the toner aggregation step in the same manner as described above. The glass transition temperature (Tg) of the resin particles used in the mixed dispersion is preferably higher than room temperature (for example, 30° C.)

In the case of using the dissolution and suspension method as a method of preparing a toner, toner particles in which inorganic particles are present on the surfaces are obtained by mixing inorganic particles (preferably, hydrophilic inorganic particles) and a mixture of a binder resin and solvents dispersed in water (oil phase) together with a dispersant, emulsifying the resultant product in the liquid, and then, removing the solvent while moving the inorganic particles to the surface of the toner particles.

In addition, toner particles in which inorganic particles are present on the surfaces are also obtained by using inorganic particles such as calcium carbonate particles or calcium phosphate particles as a dispersant used in a water phase in the dissolution and suspension method, removing the solvent, and adjusting the amount of an acid added.

Moreover, the details of the preparation method of the toner will be described later.

Examples of the inorganic particles include silica (fumed silica, sol gel silica, or the like), alumina (aluminum oxide), titania (titanium oxide), zirconia, calcium carbonate, calcium phosphate, zinc oxide, tin oxide, iron oxide, barium sulfate, and boron nitride.

Among these, as the inorganic particles, silica, calcium carbonate, alumina, and titania are more preferable.

The inorganic particles may be used alone or in combination of two or more types thereof.

The volume average particle diameter of the inorganic particles is preferably in the range of from 0.01 μm to 0.5 μm, more preferably in the range of from 0.01 μm to 0.4 μm, still more preferably in the range of from 0.03 μm to 0.3 μm, and particularly preferably in the range of from 0.05 μm to 0.2 μm. When the volume average particle diameter of the inorganic particles is in the above-described range, formation of a coarse powder is more favorably prevented.

Measurement of the volume average particle diameter of the inorganic particles is performed using a particle diameter measuring apparatus MICROTRAC (MICROTRAC UPA9340, manufactured by Nikkiso Co., Ltd.), and a cumulative volume of 50% value is employed.

The particle diameter distribution of the inorganic particles is preferably narrow from the viewpoint of preventing the formation of a coarse powder.

Although the shape of the inorganic particles may be any one of a spherical shape, an ellipsoidal shape, a polyhedral shape, a plate shape, a needle shape, a columnar shape, an irregular shape, and the like, a spherical shape is preferable from the viewpoint of preventing the formation of a coarse powder.

Although the content (weight ratio) of the inorganic particles to be contained in the toner particles varies depending on the specific gravity of the inorganic particles, the particle diameter of the toner particles, or the like, the content of the inorganic particles is preferably in the range of from 5% by weight to 20% by weight, more preferably in the range of from 7% by weight to 18% by weight, and still more preferably in the range of from 8% by weight to 16% by weight. When the content of the inorganic particles is the above-described lower limit value or greater, formation of a coarse powder is more favorably prevented. On the other hand, when the content of the inorganic particles is the above-described upper limit value or less, effects in which reduction in image strength after fixing is prevented and lifetime of an image is improved are obtained.

Moreover, the content (weight ratio) of the inorganic particles is measured by fluorescent X-ray analysis. Specifically, NET intensity of the constituent elements in the toner particles is obtained using an X-ray fluorescence spectrometer XRF 1500 (manufactured by Shimadzu Corporation), and the content is measured by quantification from the NET intensity and a calibration curve of NET intensities of 0% by weight and 100% by weight of the inorganic particles.

Plasticity Behavior with Respect to Pressure

The toner according to the exemplary embodiment satisfies the following expression (1), exhibits plasticity behavior with respect to pressure even in a state of not being heated, and exhibits fluidity under a pressure higher than a prescribed pressure.

$$20^\circ\ \text{C.} \leq T_1 - T_{10} \qquad \text{Expression (1)}$$

(In the expression (1), $T_1$ represents the temperature at which the viscosity under an applied pressure of 1 MPa becomes $10^4$ Pa·s, and $T_{10}$ represents the temperature at which the viscosity under an applied pressure of 10 MPa becomes $10^4$ Pa·s.)

The temperature difference represented by $T_1 - T_{10}$ (hereinafter, also referred to as "temperature difference ΔT") is 20° C. or greater, preferably from 20° C. to 120° C., more preferably from 40° C. to 100° C., and still more preferably from 60° C. to 80° C.

When the temperature difference ΔT is less than 20° C., plasticity behavior with respect to pressure becomes insufficient, and due to this, excellent pressure fixing performance is not exhibited. In addition, when the temperature difference ΔT is 120° C. or less, a toner does not become too soft, and due to this, migration of the toner to the fixing member or the like is prevented.

Measurement of the temperature difference ΔT is performed by a method using a flow tester (for example, CFT-500 manufactured by Shimadzu Corporation). A sample in a pellet shape is prepared by compressing and solidifying the toner. The sample prepared is set in a flow tester, and the viscosity of the sample is measured under the conditions of slowly raising (temperature raising rate of +1° C./min) the measurement temperature from 50° C. in the range of from 50° C. to 150° C. and applying a predetermined extrusion pressure. The applied pressure is fixed to 1 MPa, and the viscosity with respect to the temperature under an applied pressure of 1 MPa is measured. From the graph of the obtained viscosity, the temperature $T_1$ at which the viscosity under an applied pressure of 1 MPa becomes $10^4$ Pa·s is determined. $T_{10}$ is determined in the same manner as in $T_1$ except that the applied pressure of 1 MPa is changed to 10 MPa. The temperature difference ΔT ($T_1 - T_{10}$) is calculated from the obtained $T_1$ and $T_{10}$.

As a method of preparing a toner satisfying the above expression (1), a method in which a resin called a so-called baroplastic resin is used as a binder resin in the toner is exemplified. In addition, the toner is also controlled by the type or the amount of the inorganic particles used and the type and the amount of other additives.

Hereinafter, the baroplastic resin used as a binder resin of the toner according to the exemplary embodiment will be described with preferable two exemplary embodiments.

First Exemplary Embodiment

The toner according to the exemplary embodiment preferably includes at least two or more types of resins (binder resins) having different glass transition temperatures from the viewpoint of easily exhibiting plasticity behavior when a pressure is applied. In a case where the toner according to the exemplary embodiment includes at least the above-described two types of resins, the toner is likely to form a phase-separated structure. Thus, it is considered that the toner is likely to exhibit fluidity under a pressure higher than a prescribed pressure, and is likely to exhibit excellent pressure fixing performance.

In a case where the toner according to the exemplary embodiment includes three or more types of resins, the glass transition temperatures of at least two types of resins among the three or more types of resins may be different.

In the toner according to the exemplary embodiment, the difference between the glass transition temperatures of two types of resins is preferably 30° C. or greater, and more preferably 35° C. or greater. When the difference between the glass transition temperatures of two types of resins is 30° C. or greater, the toner including these two types of resins is likely to be fixed under a lower pressure.

The toner according to the exemplary embodiment may include three or more types of resins, and in this case, two types of resins among the three or more types of resins preferably are in the above relationship.

The content of the resin having a higher glass transition temperature between the two types of resins with respect to the total weight of the two types of resins may be from 5% by weight to 70% by weight, and is preferably from 10% by weight to 60% by weight, and more preferably from 20% by weight to 50% by weight. When the content of the resin having a higher glass transition temperature is from 5% by weight to 70% by weight, fixing under a low pressure is easily performed, and fixation of an image is unlikely to deteriorate.

In a case where the toner according to the exemplary embodiment includes three or more types of resins, the content of the two types of resins with respect to the total weight of the three or more types of resins may be from 80% by weight to 99% by weight, and is preferably from 85% by weight to 95% by weight, and more preferably from 85% by weight to 95% by weight. When the content of the two types of resins is from 80% by weight to 99% by weight, in the same manner as described above, fixing under a low pressure is easily performed.

At least one of the two types of resins having different glass transition temperatures preferably has a glass transition temperature of 40° C. or higher, more preferably 45° C. or higher, and still more preferably 50° C. or higher. When the glass transition temperature is 40° C. or higher, a toner having excellent storage properties is likely to be obtained.

The content of the resin having the glass transition temperature of 40° C. or higher may be from 5% by weight to 70% by weight, and is preferably from 10% by weight to 60% by weight, and more preferably from 20% by weight to 50% by weight with respect to the weight of the two types of resins having different glass transition temperatures.

The temperature of the resin having a higher glass transition temperature between the two types of resins may be 40° C. or higher, and is preferably from 40° C. or higher to lower than 60° C., and more preferably from 40° C. or higher to lower than 55° C. When the temperature is 60° C. or lower, fixing behavior by pressure at ordinary temperature (temperature in the apparatus of 50° C. or lower) is likely to be exhibited.

The temperature of the resin having a lower glass transition temperature between the two types of resins may be lower than 10° C., and is preferably from −100° C. or higher to lower than 10° C., and more preferably from −80° C. or higher to lower than 10° C. When the temperature is lower than 10° C., fixing under a low pressure is easily performed.

The resin composition according to the exemplary embodiment may include three or more types of resins, and in this case, it is preferable that the difference between the glass transition temperatures of two types of resins among the three or more types of resins is 30° C. or greater and the glass transition temperature of at least one of the two types of resins is 40° C. or higher.

The aspect described above for "two types of resins having different glass transition temperatures" may also be applied to "two types of resins having different melting temperatures" and "amorphous resin and crystalline resin having different glass transition temperatures and melting temperatures" in some cases.

The glass transition temperature may be controlled mainly by the density of a rigid unit such as an aromatic ring or a cyclohexane ring in the main chain of the resin. That is, when the density of a methylene group, an ethylene group, an oxyethylene group, or the like in the main chain is high, the glass transition temperature is lowered, and when an aromatic ring, a cyclohexane ring, or the like is increased, the glass transition temperature rises. Furthermore, when the density of the side chain of an aliphatic compound is increased, the glass transition temperature is lowered. Considering these, it is possible to obtain resins having various glass transition temperatures.

In addition, similarly, the melting temperature may also be controlled by the density of a rigid unit.

Hereinafter, in a case where the two types of resins are two types of amorphous resins having different glass transition temperatures, description will be made by referring to the resin having a higher glass transition temperature as "high Tg resin", and the resin having a lower glass transition temperature as "low Tg resin".

In a case where the two types of resins are two types of crystalline resins having different melting temperatures, description will be made by referring to the resin having a higher melting temperature as "high melting temperature resin", and the resin having the lower melting temperature as "low melting temperature resin".

In a case where the two types of resins are a amorphous resin and a crystalline resin of which the glass transition temperature and the melting temperature are different, description will be made by referring to the resin having the glass transition temperature higher than the melting temperature as "high Tg resin" "low melting temperature resin", and the resin having the glass transition temperature lower than the melting temperature as "low Tg resin" "high melting temperature resin".

As an aspect in which the toner according to the exemplary embodiment includes a high Tg resin and a low Tg resin, an aspect in which a phase-separated structure in which plasticity behavior is easily exhibited when a pressure is applied may be formed is preferable. Examples of the aspect may include a toner including a mixture including both a high Tg resin and a low Tg resin; a toner including a resin in which a high Tg resin and a low Tg resin form a sea-island structure; and a toner including resin particles in which a high Tg resin and a low Tg resin form a core/shell structure.

An aspect in which the toner according to the exemplary embodiment includes a high melting temperature resin and a low melting temperature resin, an aspect in which the toner includes a high Tg resin and a low melting temperature resin, and an aspect in which the toner includes a low Tg resin and a high melting temperature resin are also the same as the aspect in which the toner includes a high Tg resin and a low Tg resin described above except that the types of resins are changed.

Hereinafter, examples of the aspect of the toner according to the exemplary embodiment will be described in more detail using the aspect in which the toner includes a high Tg resin and a low Tg resin as an example.

Examples of the mixture including both a high Tg resin and a low Tg resin include a resin particle dispersion obtained by mixing a resin particle dispersion in which the particles of a high Tg resin are dispersed and a resin particle dispersion in which the particles of a low Tg resin are dispersed; a powder obtained by mixing a powder including a high Tg resin and a powder including a low Tg resin; and a solid obtained by melting and mixing a solid including a high Tg resin and a solid including a low Tg resin.

A resin in which a high Tg resin and a low Tg resin form a sea-island structure forms a phase-separated structure in which an island phase is present in a sea phase. In the resin in which a sea-island structure is formed, the high Tg resin may be a sea phase, and the low Tg resin may be an island phase, or the high Tg resin may be an island phase, and the low Tg resin may be a sea phase; however, it is preferable that the high Tg resin is a sea phase, and the low Tg resin is an island phase.

The sea-island structure of the resin included in the toner is confirmed by the method shown below. After embedding the toner into an epoxy resin, a slice is prepared using a diamond knife or the like, then, the prepared slice is dyed with osmium tetraoxide in a desiccator, and then, the structure of the resin is confirmed by observing the dyed slice using a transmission electron microscope. Here, the sea phase and the island phase in the sea-island structure are distinguished by shade due to the dyed degree of the resin by osmium tetraoxide.

The long diameter of the island phase is preferably 150 nm or less. In a case where the high Tg resin is a sea phase, and the low Tg resin is an island phase, the low Tg resin phase which becomes the island phase is preferably finely distributed, and in this case, the diameter of the island phase is preferably 150 nm or less, more preferably 5 nm to 150 nm, still more preferably 50 nm to 140 nm, and particularly preferably 100 nm to 130 nm. When the diameter of the island phase is 150 nm or less, pressure plasticity behavior is likely to be sufficient, and fixing is easy at the time of pressure fixing. When the diameter of the island phase is 5 nm or greater, the high Tg resin and the low Tg resin are likely to favorably form the sea-island structure without being mixed and dissolved, and blocking, which is caused by being plasticized even at ordinary temperature in a state of not being pressurized, is unlikely to be caused.

The long diameter of the island phase may be calculated by the following method. After embedding the toner into an epoxy resin, a slice is prepared using a diamond knife or the like, and then, the obtained slice is observed using a transmission electron microscope. The long diameter of the island phase may be obtained by arbitrary selecting 100 island phases observed in the slice and calculating the average long diameter using a LUZEX image analyzer.

The weight ratio of the resin forming the island phase is preferably 0.25 or greater with respect to the weight of the resin forming the sea phase.

In order to exhibit a suitable pressure plasticity behavior, for example, in a case where the high Tg resin is the sea phase, and the low Tg resin is the island phase, the weight ratio of the low Tg resin is preferably 0.3 or greater, more preferably 0.4 or greater, and still more preferably 0.5 or greater with respect to the weight of the high Tg resin.

In addition, the weight ratio of the low Tg resin is preferably less than 1.5 with respect to the weight of the high Tg resin. When the weight ratio is less than 1.5, plasticization at ordinary temperature is unlikely to occur.

The resin which may be used for forming the sea-island structure, for example, may be an addition polymerization type resin and a polycondensation resin.

The resin particles in which the high Tg resin and the low Tg resin form the core/shell structure is a resin particle having a core (core particle) and a coating layer (shell layer) coating the core.

Although the high Tg resin may be a core, and the low Tg resin may be a coating layer, or the high Tg resin may be a coating layer, and the low Tg resin may be a core, preferably, the high Tg resin is a coating layer, and the low Tg resin is a core.

The diameter of the core is preferably from 10 nm to 200 nm, and more preferably from 20 nm to 150 nm. The thickness of the coating layer is preferably from 10 nm to 100 nm, and more preferably from 20 nm to 80 nm.

The core/shell structure is confirmed by the method shown below. After embedding the toner into an epoxy resin, a slice is prepared using a diamond knife or the like, and then, the structure of the resin particle is confirmed by observing the obtained slice using a transmission electron microscope.

The resin which may be used for forming the core/shell structure, for example, may be an addition polymerization type resin and a polycondensation resin.

Second Embodiment

The toner according to the exemplary embodiment favorably includes a resin having two glass transition temperatures in a molecule from the viewpoint of easily exhibiting plasticity behavior when a pressure is applied. In a case where the toner according to the exemplary embodiment includes the resin, the toner is likely to form a phase-separated structure. Thus, it is considered that the toner is likely to exhibit fluidity under a pressure higher than a prescribed pressure, and is likely to exhibit excellent pressure fixing performance.

In a resin having two glass transition temperatures in one molecule, the difference of the two glass transition temperatures is preferably 30° C. or greater, and more preferably 50° C. or greater, from the viewpoint of easy fixing of a toner at a lower pressure.

In a case where a resin has two glass transition temperatures in one molecule, the resin is preferably a block copolymer or a graft copolymer of resins having different glass transition temperatures. In this case, a segment derived from the resin having a high glass transition temperature is referred to as "high Tg segment", and a segment derived from the resin having a low glass transition temperature is referred to as "low Tg segment".

The proportion of the high Tg segment in the resin is preferably from 5% by weight to 70% by weight, and more preferably from 10% by weight to 60% by weight. When the proportion of the high Tg segment is from 5% by weight to 70% by weight, fixing under a low pressure is easily performed, and fixation of an image is unlikely to deteriorate.

The resin preferably has a glass transition temperature of 40° C. or higher, more preferably 45° C. or higher, and still more preferably 50° C. or higher. When the glass transition temperature is 40° C. or higher, a toner having excellent storage properties is likely to be obtained.

As long as the above-described block copolymer exhibits the plasticity behavior when a pressure is applied, the joining type of the constituent segments thereof may be any type.

Examples of the block copolymer may include block copolymers of an AB type, an ABA type, a BAB type, an (AB), type, a $(AB)_nA$ type, $B(AB)_n$ type when indicating the high Tg segment as A and the low Tg segment as B.

Although the phase separation structure formed by the block copolymer varies depends on the type and molecular weight of the constituent segment, the phase separation structure is present as a thermodynamically most stable structure, and, in general, in a copolymer consisting of a C segment and a D segment, the structure varies depending on only the C/D composition ratio regardless of the joining type, and when the C/D ratio is increased, C is changed to a spherical domain and D is changed to a matrix (C sphere D matrix) (sea-island), C is changed to a rod shape domain, D is changed to a matrix (cylinder), and C and D are changed to nests (Gyroid) or C/D alternating layers (lamellae), D is changed to a rod shape domain, C is changed to a matrix (cylinder), and D and C are changed to nests (Gyroid), and D is changed to a spherical domain and C is changed to the matrix (D sphere C matrix) (sea-island) systematically.

However, in a case where the toner particles are prepared by a wet method, it is possible to control the phase separation state arbitrarily by solvent used, a drying speed, or the like. For example, even in the case of a great C/D ratio and taking the D sphere C matrix thermodynamically, if a solvent which is a good solvent with respect to D and is a poor solvent with respect to C is selected as a solvent, the C sphere D matrix structure may be obtained.

In addition, when a good solvent with respect to both C and D is used and then the solvent is rapidly removed, a phase separation structure (modulated structure) frozen in a spinodal decomposition state may be obtained. In addition, when a polymer which is compatible with only D is added to the copolymer which has a great C/D ratio and takes the D sphere C matrix thermodynamically, a phase separation structure in which C is a sphere, D and the polymer which is compatible with only D become a matrix may also be obtained.

The size of the repeating unit of the phase separation structure formed by the block copolymer is increased with the increase in the molecular weight of the block copolymer. The weight average molecular weight of the block copolymer may be from 3,000 to 500,000, preferably from 5,000 to 400,000, and more preferably from 6000 to 300,000.

The C sphere D matrix and the D sphere C matrix represent resin particles in which a block copolymer having a high Tg segment and a low Tg segment forms a sea-island structure, or a composition including this. The sea-island structure is the same as the sea-island structure formed by the high Tg resin and the low Tg resin described above.

The block copolymer or the graft copolymer having a high Tg segment and a low Tg segment may take an aspect of resin particles in which the core/shell structure is formed. The core/shell structure is the same as the core/shell structure formed by the high Tg resin and the low Tg resin described above.

In addition, as a method of producing resin particles in which the block copolymer or the graft copolymer forms the core/shell structure, for example, there is a method in which aggregated particles which become a core are prepared by an emulsion aggregating method, and then shell layers are formed by polymerizing a monomer on the surfaces of the aggregated particles, and as a result, the resin particles are produced.

As a method of synthesizing the block copolymer or the graft polymer, any suitable one among synthetic methods described in documents such as "Courses in Experimental Chemistry 28, Polymer Synthesis" (4th edition) (Maruzen Publishing Co., Ltd., 1992)", "Chemistry and Industry of Macromonomer (IPC, 1990)", "Compatibilization and Evaluation Technology of Polymer (Technical Information Institute Co., Ltd., 1992)", "New Polymer Material, One Point 12, Polymer Alloy (Kyoritsu, 1988)", "Angew. Macromol. Chem., 143, pp. 1-9 (1986)", "Journal of the Adhesion Society of Japan, 26, pp. 112-118 (1990)", "Macromolecules, 28, pp. 4893-4898 (1995)", "J. Am. Chem. Soc., 111, pp. 7641-7643 (1989)", and "JP-A-6-83077" may preferably be used.

The resin used for synthesizing a block copolymer or a graft copolymer, for example, may preferably be an addition polymerization type resin and a polycondensation resin.

Temperature Characteristics of Resin

The "crystallinity" of a resin indicates that the resin has not a stepwise change in an endothermic amount but a definite endothermic peak, in the differential scanning calorimetry, and, specifically, indicates that the resin has a half-value width of the endothermic peak, when measuring at a temperature rising rate of 10 (° C./min), of not greater than 10° C. In addition, the "amorphousness" of a resin indicates that, the half-value width is greater than 10° C., the resin shows a stepwise change in an endothermic amount, and a definite endothermic peak is not observed, in the differential scanning calorimetry.

Moreover, the glass transition temperature of a resin is determined by a DSC curve obtained by differential scanning calorimetry (DSC), and more specifically, is determined by "an extrapolated starting temperature of glass transition" described in a method of determining a glass transition temperature of "transition temperature measuring method of plastic" in JIS K-7121-1987. In addition, the melting temperature of a resin is determined by "Melting Peak Temperature" described in a method of determining a melting temperature of "Testing Methods for Transition Temperatures of Plastics" in JIS K-7121-1987 from a DSC curve obtained by differential scanning calorimetry (DSC).

As an example, for measurement of the glass transition temperature of a toner including a high Tg resin and a low Tg resin, each aspect of toners will be described.

In the case of an aspect in which a toner includes a mixture including both a high Tg resin and a low Tg resin, each of the glass transition temperatures of the high Tg resin and the low Tg resin before mixing is measured.

In the case of an aspect in which a toner includes a resin in which a high Tg resin and a low Tg resin form a sea-island structure, each of the glass transition temperatures of the high Tg resin and the low Tg resin before preparing the resin in which a sea-island structure is formed is measured.

In the case of an aspect in which a toner includes resin particles in which a high Tg resin and a low Tg resin form the core/shell structure, and of preparing the resin particles by an emulsion aggregating method, each of the glass transition temperatures of the high Tg resin and the low Tg resin before preparing the resin particles is measured.

The method of measuring the melting temperature of a toner including a high melting temperature resin and a low melting temperature resin is also the same as the method of measuring the glass transition temperature of the toner including a high Tg resin and a low Tg resin except that the glass transition temperature is changed to the melting temperature. In addition, the method of measuring the glass transition temperature and the melting temperature of a toner obtained by combining other resins, such as a toner including a high Tg resin and a low melting temperature resin is also the same as the measurement method described above.

In a case where a toner includes a block copolymer or a graft copolymer having a high Tg segment and a low Tg segment, DSC measurement of the block copolymer or the graft copolymer in the toner is performed and from the obtained DSC curve, the glass transition temperature resulting from the high Tg segment and the glass transition temperature resulting from the low Tg segment in the molecule of the block copolymer or the graft copolymer are determined.

The method of measuring the glass transition temperature and the melting temperature of a toner including a block copolymer or a graft copolymer of another aspect is also the same.

Resin

The resin (binder resin) will be described.

Examples of the resin may include an addition polymerization type resin and a polycondensation resin.

The addition polymerization type resin is a polymer of a monomer having an ethylenically unsaturated double-bond.

Examples of the monomer (monomer having an ethylenically unsaturated double-bond) configuring the addition polymerization type resin may include styrenes such as styrene, parachlorostyrene and α-methyl styrene; (meth) acrylic acid esters such as methyl acrylate, ethyl acrylate, propyl acrylate, butyl acrylate, lauryl acrylate, 2-ethylhexyl acrylate, methyl methacrylate, ethyl methacrylate, propyl methacrylate, butyl methacrylate, hexyl methacrylate, lauryl methacrylate, and 2-ethylhexyl methacrylate; (meth)acrylonitriles such as acrylonitrile and methacrylonitrile; ethylenically unsaturated carboxylic acids such as acrylic acid, methacrylic acid, and crotonic acid; vinyl ethers such as vinyl methyl ether, and vinyl isobutyl ether; vinyl ketones such as vinyl methyl ketone, vinyl ethyl ketone, and vinyl isopropenyl ketone; olefins such as isoprene, butene, and butadiene, and β-carboxyethyl acrylate. The resin may be a homopolymer formed by polymerizing one type of these monomers, a copolymer formed by copolymerizing two or more types of these monomers, or a mixture thereof.

The addition polymerization type resin may contain an acidic polar group, a basic polar group, or an alcoholic hydroxyl group, as necessary. Examples of the acidic polar group may include a carboxy group, a sulfonic acid group, and acid anhydride.

Examples of the monomer for incorporating the acidic polar group into the addition polymerization type resin may include α,β-ethylenically unsaturated compounds having a carboxy group or a sulfonic acid group. Among these monomers, acrylic acid, methacrylic acid, fumaric acid, maleic acid, itaconic acid, cinnamic acid, sulfonated styrene, or allyl sulfosuccinic acid is preferable.

Examples of the basic polar group may include an amino group, an amide group, and hydrazide group.

Examples of the monomer for incorporating the basic polar group into the addition polymerization type resin may include monomers having a nitrogen atom (hereinafter, also referred to as "nitrogen-containing monomer"). Among these nitrogen-containing monomers, a (meth)acrylic amide compound, a (meth)acrylic hydrazide compound, or amino alkyl (meth)acrylate compound is preferable.

Here, the notation "(meth)acrylic acid" or the like described above is a simple notation representing that both of the structures of methacrylic acid and acrylic acid may be taken. The following notations are also the same.

Examples of the (meth)acrylamide compound may include acrylic amide, methacrylic amide, acrylic methylamide, methacrylic methylamide, acrylic dimethyl amide, acrylic diethylamide, acrylic phenylamide, and acrylic benzylamide.

Examples of the (meth)acrylic hydrazide compound may include acrylic hydrazide, methacrylic hydrazide, acrylic methyl hydrazide, methacrylic methylhydrazide, acrylic dimethyl hydrazideacid, and acrylic phenyl hydrazide.

The amino alkyl (meth)acrylate compound may be a monoalkyl aminoalkyl (meth)acrylate compound or a dialkyl aminoalkyl (meth)acrylate compound. Examples of the amino alkyl (meth)acrylate compound may include 2-aminoethyl acrylate, 2-aminoethyl methacrylate, and 2-(diethylamino)ethyl (meth)acrylate.

As the monomer for forming an alcoholic hydroxyl group, for example, hydroxy(meth)acrylates are preferable, and specific examples thereof include 2-hydroxyethyl (meth) acrylate, hydroxypropyl (meth)acrylate, and hydroxybutyl (meth)acrylate.

A chain transfer agent may be used in polymerization of the addition polymerization type resin.

The chain transfer agent is not particularly limited, and examples thereof may include a compound having a thiol component. Examples of the compound having a thiol component may include mercaptan. Among the mercaptans, alkyl mercaptans such as hexyl mercaptan, heptyl mercaptan, octyl mercaptan, nonyl mercaptan, decyl mercaptan, and dodecyl mercaptan are preferable.

It is also possible to obtain a crosslinked resin by adding a crosslinking agent to the addition polymerization type resin. Examples of the crosslinking agent may include a polyfunctional monomer having two or more ethylenically unsaturated group in the molecule.

Examples of the polyfunctional monomer may include aromatic polyvinyl compounds such as divinyl benzene and divinyl naphthalene; polyvinyl esters of aromatic polycarboxylic acid such as divinyl phthalate, divinyl isophthalate, divinyl terephthalate, divinyl homophthalate, divinyl/trivinyl trimesate, divinyl naphthalene dicarboxylate, and divinyl biphenyl carboxylate; divinyl esters of nitrogen-containing aromatic compounds such as divinyl pyridinedicarboxylate; vinyl esters of an unsaturated heterocyclic compound carboxylic acid such as vinyl pyromucate, vinyl furancarboxylate, vinyl pyrrole-2-carboxylate, and vinyl thiophenecarboxylate; (meth)acrylic acid esters of straight-chain polyols such as butanediol methacrylate, hexanediol acrylate, octanediol methacrylate, decanediol acrylate, and dodecanediol methacrylate; (meth)acrylic acid esters of branched and substituted polyols such as neopentyl glycol dimethacrylate and 2-hydroxy-1,3-diacryloxypropane; polyethylene glycol di(meth)acrylates and polypropylene polyethylene glycol di(meth)acrylates; and polyvinyl esters of polycarboxylic acid such as divinyl succinate, divinyl fumarate, vinyl/divinyl maleate, divinyl diglycolate, vinyl/divinyl itaconate, divinyl acetone dicarboxylate, divinyl glutarate, divinyl 3,3'-thiodipropionate, divinyl/trivinyl trans-aconitate, divinyl adipate, divinyl pimelate, divinyl suberate, divinyl azelate, divinyl sebacate, divinyl dodecanedioate, and divinyl brassylate. These crosslinking agents may be used alone or in combination of two or more types thereof.

Among the crosslinking agents, (meth)acrylic acid esters of straight-chain polyols such as butanediol methacrylate, hexanediol acrylate, octanediol methacrylate, decanediol acrylate, and dodecanediol methacrylate; (meth)acrylic acid esters of branched and substituted polyols such as neopentyl glycol dimethacrylate and 2-hydroxy-1,3-diacryloxypropane; or polyethylene glycol di(meth)acrylates and polypropylene polyethylene glycol di(meth)acrylates are preferably used.

The content of the crosslinking agent is preferably from 0.05% by weight to 5% by weight, and more preferably from 0.1% by weight to 1.0% by weight of the total amount of monomers configuring the addition polymerization type resin.

The addition polymerization type resin may be prepared by radical polymerization using a radical polymerization initiator. The radical polymerization initiator is not particularly limited, and examples thereof may include a known radical polymerization initiator.

The content of the radical polymerization initiator used is preferably from 0.01% by weight to 15% by weight, and more preferably from 0.1% by weight to 10% by weight of the total amount of monomers configuring the addition polymerization type resin.

The weight average molecular weight of the addition polymerization type resin is preferably from 1,500 to 60,000, and more preferably from 3,000 to 40,000.

Moreover, the weight average molecular weight (Mw) and the number average molecular weight (Mn) are measured by gel permeation chromatography (GPC). In the molecular weight measurement by GPC, HLC-8120GPC, a GPC manufactured by Tosoh Corporation is used as a measurement apparatus, TSKGEL SUPER HM-M (15 cm), a column manufactured by Tosoh Corporation is used as a column, and a THF solvent is used. The weight average molecular weight and the number average molecular weight are calculated using a molecular weight calibration curve prepared by monodisperse polystyrene standard samples from the measurement results.

Examples of the polycondensation resin may include a polyester resin. The polyester resin may be crystalline or amorphous.

Examples of the monomer configuring the polyester resin may include polycarboxylic acids containing two or more carboxyl groups in one molecule and polyols containing two or more hydroxyl groups in one molecule, and hydroxycarboxylic acids.

Among polycarboxylic acids used for obtaining a crystalline polyester resin, examples of a dicarboxylic acid may include oxalic acid, glutaric acid, succinic acid, maleic acid, adipic acid, β-methyl adipic acid, azelaic acid, sebacic acid, nonane dicarboxylic acid, decane dicarboxylic acid, undecane dicarboxylic acid, dodecane dicarboxylic acid, fumaric acid, citraconic acid, diglycolic acid, cyclohexane-3,5-diene-1,2-carboxylic acid, malic acid, citric acid, hexahydroterephthalic acid, malonic acid, pimelic acid, tartaric acid, mucic acid, phthalic acid, isophthalic acid, terephthalic acid, tetrachlorophthalic acid, chlorophthalic acid, nitrophthalic acid, p-carboxyphenyl acetic acid, p-phenylene diacetic acid, m-phenylene diglycolic acid, p-phenylene diglycolic acid, o-phenylene diglycolic acid, diphenyl acetic acid, diphenyl-p,p'-dicarboxylic acid, naphthalene-1,4-dicarboxylic acid, naphthalene-1,5-dicarboxylic acid, naphthalene-2,6-dicarboxylic acid, anthracene dicarboxylic acid, and 1,4-cyclohexane dicarboxylic acid. These dicarboxylic acids may be used alone or in combination of two or more types thereof.

Examples of polycarboxylic acids except for the dicarboxylic acids may include trimellitic acid, pyromellitic acid, naphthalene tricarboxylic acid, naphthalene tetracarboxylic acid, pyrene tricarboxylic acid, and pyrene tetracarboxylic acid.

In addition, acid anhydrides, mixed acid anhydrides, acid chlorides, or esters derived from the carboxy groups of these carboxylic acids may be used. Among the polycarboxylic acids except for the dicarboxylic acids, one type thereof may be used alone, or two or more types thereof may be used in combination. These polycarboxylic acids may be used alone or in combination of two or more types thereof.

Examples of the polyol used for obtaining a crystalline polyester resin may include ethylene glycol, diethylene glycol, triethylene glycol, 1,2-propylene glycol, 1,3-propylene glycol, 1,4-butanediol, 1,4-butenediol, neopentyl glycol, 1,5-pentane glycol, 1,6-hexane glycol, 1,4-cyclohexane diol, 1,4-cyclohexane dimethanol, dipropylene glycol, polyethylene glycol, polypropylene glycol, polytetramethylene glycol, bisphenol A, bisphenol Z, hydrogenated bisphenol A, cyclohexane dimethanol, and alkylene oxide adducts thereof. Among these polyols, one type thereof may be used alone, or two or more types thereof may be used in combination.

By polycondensing the polycarboxylic acid and the polyol in combination, a desired crystalline polyester resin is obtained.

Examples of the crystalline polyester resin may include a polyester resin obtained by polycondensing 1,9-nonanediol and 1,10-decane dicarboxylic acid, a polyester resin obtained by polycondensing cyclohexanediol and adipic acid, a polyester resin obtained by polycondensing 1,6-hexanediol and sebacic acid, a polyester resin obtained by polycondensing ethylene glycol and succinic acid, a polyester resin obtained by polycondensing ethylene glycol and sebacic acid, and a polyester resin obtained by polycondensing 1,4-butanediol and succinic acid.

In addition, each one type of the polycarboxylic acids and the polyols may be used, one type of one of the polycarboxylic acids and the polyols and two or more types of the other of the polycarboxylic acids and the polyols may be used, and two or more types of the polycarboxylic acids and two or more types of the polyols may be used, respectively. In the case of using hydroxycarboxylic acid as a monomer, one type thereof may be used alone, two or more types thereof may be used in combination, or the polycarboxylic acid or the polyol may be used in combination.

As the polycarboxylic acid used for obtaining a amorphous polyester resin, for example, dicarboxylic acids among the above-described polycarboxylic acids may be exemplified, and examples thereof may include phthalic acid, isophthalic acid, terephthalic acid, tetrachlorophthalic acid, chlorophthalic acid, nitrophthalic acid, p-carboxyphenyl acetic acid, p-phenylene diacetic acid, m-phenylene diglycolic acid, p-phenylene diglycolic acid, o-phenylene diglycolic acid, diphenyl acetic acid, diphenyl-p,p'-dicarboxylic acid, naphthalene-1,4-dicarboxylic acid, naphthalene-1,5-dicarboxylic acid, naphthalene-2,6-dicarboxylic acid, anthracene dicarboxylic acid, and cyclohexane dicarboxylic acid.

In addition, examples of polycarboxylic acids except for the dicarboxylic acids may include trimellitic acid, pyromellitic acid, naphthalene tricarboxylic acid, naphthalene tetracarboxylic acid, pyrene tricarboxylic acid, and pyrene tetracarboxylic acid. In addition, acid anhydrides, acid chlorides, or esters derived from the carboxy groups of these carboxylic acids may be used. These polycarboxylic acids may be used alone or in combination of two or more types thereof.

Among these, terephthalic acid or lower esters thereof, diphenyl acetic acid, 1,4-cyclohexane dicarboxylic acid, or the like is preferably used. Moreover, the lower ester refers to an ester of an aliphatic alcohol having 1 to 8 carbon atoms.

Examples of the polyol used for obtaining an amorphous polyester resin may include the above-described polyols. Among these polyols, in particular, polytetramethylene glycol, bisphenol A, bisphenol Z, hydrogenated bisphenol A, cyclohexane dimethanol, alkylene oxide adducts thereof, or the like is preferably used. These polyols may be used alone or in combination of two or more types thereof.

In addition, by combining the polycondensation monomer, it is possible to easily obtain an amorphous resin or a crystalline resin.

In order to preparing one type of a polycondensation resin, each one type of the polycarboxylic acids and the polyols may be used, one type of one of the polycarboxylic acids and the polyols and two or more types of the other of the polycarboxylic acids and the polyols may be used, and two or more types of the polycarboxylic acids and two or more types of the polyols may be used, respectively. In addition, in the case of using hydroxycarboxylic acid to prepare one type of a polycondensation resin, one type thereof may be used alone, two or more types thereof may be used, or the polycarboxylic acid or the polyol may be used in combination.

The weight average molecular weight of the polycondensation resin is preferably from 1,500 to 60,000, and more preferably from 3,000 to 40,000. In addition, the polycondensation resin may have partial branching or a bridge structure, by selection of valence of carboxylic acid and valence of alcohol of a monomer.

Colorant

Examples of the colorant include various pigments such as carbon black, chrome yellow, hansa yellow, benzidine yellow, threne yellow, quinoline yellow, pigment yellow, permanent orange GTR, pyrazolone orange, vulcan orange, watching red, permanent red, brilliant carmine 3B, brilliant carmine 6B, DuPont oil red, pyrazolone red, lithol red, rhodamine B lake, lake red C, pigment red, rose bengal, aniline blue, ultramarine blue, calco oil blue, methylene blue chloride, phthalocyanine blue, pigment blue, phthalocyanine green, and malachite green oxalate, or various dyes such as an acridine dye, a xanthene dye, an azo dye, a benzoquinone dye, an azine dye, an anthraquinone dye, a thioindigo dye, a dioxazine dye, a thiazine dye, an azomethine dye, an indigo dye, a phthalocyanine dye, an aniline black dye, a polymethine dye, a triphenylmethane dye, a diphenylmethane dye, and a thiazole dye.

The colorants may be used alone or in combination of two or more types thereof.

As the colorant, a surface-treated colorant may be used as necessary, or the colorant may be used in combination with a dispersant. In addition, plural types of colorants may be used in combination.

The content of the colorant, for example, is preferably from 1% by weight to 30% by weight, and more preferably from 3% by weight to 15% by weight with respect to the total toner particles.

Release Agent

Examples of the release agent include hydrocarbon waxes; natural waxes such as a carnauba wax, a rice wax, and a candelilla wax; synthetic or mineral/petroleum waxes such as a montan wax; ester waxes such as fatty acid ester and montanic acid ester; and the like. However, the release agent is not limited thereto.

The melting temperature of the release agent is preferably from 50° C. to 110° C., and more preferably from 60° C. to 100° C.

Moreover, the melting temperature of the release agent is obtained from "melting peak temperature" described in the method of obtaining a melting temperature in JIS K-1987 "Testing methods for transition temperatures of plastics", from a DSC curve obtained by differential scanning calorimetry (DSC).

The content of the release agent, for example, is preferably from 1% by weight to 20% by weight, and more preferably from 5% by weight to 15% by weight with respect to the total toner particles.

Other Additives

Examples of other additives include known additives such as a magnetic material, a charge-controlling agent, and an inorganic powder. These additives are included in toner particles as an internal additive.

Characteristics of Toner Particles

The toner particles may be toner particles having a single-layer structure, or toner particles having a so-called core/shell structure configured of a core (core particle) and a coating layer (shell layer) coated on the core.

Here, the toner particles having the core/shell structure may preferably be configured to have a core configured to include a binder resin and as necessary, other additives such as a colorant and a release agent, and a coating layer configured to include a binder resin.

The volume average particle diameter (D50v) of the toner particles is preferably from 2 μm to 10 μm, and more preferably from 4 μm to 8 μm.

Moreover, various average particle diameters and various particle diameter distribution indices of the toner particles are measured using a COULTER MULTISIZER II (manufactured by Beckman Coulter, Inc.), and ISOTON-II (manufactured by Beckman Coulter, Inc.) as an electrolyte solution.

In the measurement, from 0.5 mg to 50 mg of a measurement sample is added to 2 ml of a 5% aqueous solution of a surfactant (preferably, sodium alkylbenzene sulfonate) as a dispersant. The resultant product is added to from 100 ml to 150 ml of the electrolyte solution.

The electrolyte solution in which the sample is suspended is subjected to a dispersion treatment using an ultrasonic disperser for 1 minute, and a particle diameter distribution of particles having a particle diameter from 2 μm to 60 μm is measured by a COULTER MULTISIZER II using an aperture having an aperture diameter of 100 Moreover, 50,000 particles are sampled.

Cumulative distributions by volume and by number are drawn from the side of the smallest diameter with respect to particle diameter ranges (channels) separated based on the measured particle diameter distribution. The particle diameter when the cumulative percentage becomes 16% is defined as that corresponding to a volume particle diameter D16v and a number particle diameter D16p, while the particle diameter when the cumulative percentage becomes 50% is defined as that corresponding to a volume average particle diameter D50v and a number average particle diameter D50p. Furthermore, the particle diameter when the cumulative percentage becomes 84% is defined as that corresponding to a volume particle diameter D84v and a number particle diameter D84p.

Using these, a volume average particle diameter distribution index (GSDv) is calculated as $(D84v/D16v)^{1/2}$, while a number average particle diameter distribution index (GSDp) is calculated as $(D84p/D16p)^{1/2}$.

The shape factor SF1 of the toner particles is preferably from 110 to 150, and more preferably from 120 to 140.

Moreover, the shape factor SF1 is obtained through the following equation.

$$SF1=(ML^2/A)\times(\pi/4)\times 100 \quad \text{Equation:}$$

In the above equation, ML represents an absolute maximum length of a toner particle, and A represents a projected area of a toner particle.

Specifically, the shape factor SF1 is numerically converted mainly by analyzing a microscopic image or a scanning electron microscopic (SEM) image by the use of an image analyzer, and is calculated as follows. That is, an optical microscopic image of particles scattered on a surface of a glass slide is input to an image analyzer LUZEX through a video camera to obtain maximum lengths and projected areas of 100 particles, values of SF1 are calculated through the above equation, and an average value thereof is obtained.

External Additive

Examples of the external additive include inorganic particles. Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)$ n, $Al_2O_3.2SiO_2$, $CaCO_3$, $MgCO_3$, $BaSO_4$, and $MgSO_4$.

The surface of the inorganic particles as an external additive may be subjected to a hydrophobizing treatment. The hydrophobizing treatment is performed by, for example, dipping the inorganic particles in a hydrophobizing agent. The hydrophobizing agent is not particularly limited, and examples thereof include a silane coupling agent, silicone oil, a titanate coupling agent, and an aluminum coupling agent. These may be used alone or in combination of two or more types thereof.

Generally, the amount of the hydrophobizing agent is, for example, from 1 part by weight to 10 parts by weight with respect to 100 parts by weight of the inorganic particles.

Examples of the external additive also include resin particles (resin particles such as polystyrene particles, polymethyl methacrylate (PMMA) particles, and melamine resin particles) and a cleaning aid (for example, metal salts of higher fatty acids represented by zinc stearate and particles of a fluorine high molecular weight material).

The amount of external additive externally added, for example, is preferably from 0.01% by weight to 5% by weight, and more preferably from 0.01% by weight to 2.0% by weight with respect to the toner particles.

Preparation Method of Toner

The preparation method of the toner according to the exemplary embodiment is not particularly limited, and the toner particles are prepared by a dry method such as a known kneading and pulverizing method, or a wet method such as an emulsion aggregating method or a dissolution and suspension method. Among these methods, the emulsion aggregating method or the dissolution and suspension method is preferable.

Emulsion Aggregating Method

The emulsion aggregating method in the exemplary embodiment may have an emulsifying step of forming resin particles (emulsified particles) by emulsifying raw materials constituting the toner, an aggregation step of forming aggregate including the resin particles, and a coalescing step of coalescing the aggregate.

Moreover, in the exemplary embodiment, the inorganic particles are made to be present in a state of being embedded into the surface of a toner particle and being exposed. Thus, it is preferable that inorganic particles are dispersed together with a surfactant or the like using a homogenizer, the resultant product is added in a state of a dispersion at the end of the aggregation step, and the inorganic particles are coalesced with the surfaces of the toner particles by further heating. In addition, in the case of forming shell layers on the surfaces of toner particle as a complex of a resin and inorganic particles, it is preferable that a mixed dispersion of inorganic particles and resin particles is added at the end of the toner aggregation step in the same manner as described above.

Emulsifying Step

For example, the preparation of a resin particle dispersion may be performed by applying a shearing force by a disperser to a solution obtained by mixing an aqueous medium and a binder resin. At that time, particles may be formed by reducing the viscosity of the resin component by heating. In addition, a dispersant may be used to stabilize the dispersed resin particles.

Furthermore, when the resin is oily and is dissolved in a solvent having a relatively low solubility in water, the resin is particle-dispersed in water with a dispersant or a polymer electrolyte after being dissolved in the solvent, and then the solvent is evaporated by heating or reducing pressure, and thereby a resin particle dispersion is prepared.

In the exemplary embodiment, as a binder resin used in the emulsifying step, the above-described baroplastic resin is preferably used.

Examples of the aqueous medium include water such as distilled water and ion exchange water; and alcohols, and among these, water is preferable.

In addition, examples of the dispersant used in the emulsifying step include water-soluble polymers such as polyvinyl alcohol, methyl cellulose, ethyl cellulose, hydroxyethyl cellulose, carboxymethyl cellulose, sodium polyacrylate, and poly(sodium methacrylate); surfactants including anionic surfactants such as sodium dodecylbenzene sulfonate, sodium octadecyl sulfate, sodium oleate, sodium laurate, and potassium stearate, cationic surfactants such as lauryl amine acetate, stearyl amine acetate, and lauryl trimethyl ammonium chloride, ampholytic surfactants such as lauryl dimethyl amine oxide, and nonionic surfactants such as polyoxyethylene alkyl ether, polyoxyethylene alkyl phenyl ether, and polyoxyethylene alkyl amine; and inorganic salts such as tricalcium phosphate, aluminum hydroxide, calcium sulfate, calcium carbonate, and barium carbonate.

Examples of the disperser used for the preparation of the emulsion include a homogenizer, a homomixer, a pressure kneader, an extruder, and a media disperser. As the resin particle diameter, the average particle diameter (volume average particle diameter) is preferably 1.0 μm or less, more preferably in the range of from 60 nm to 300 nm, and still more preferably in the range of from 150 nm to 250 nm.

When the particle diameter is less than 60 nm, the resin particles are stable in a dispersion, and thus, there is a case where aggregation of the resin particles is difficult. In addition, when the particle diameter is greater than 1.0 μm, aggregability of the resin particles is improved, and thus it is easy to prepare the toner particles, however, there is a case where distribution of the toner particle diameters is widen.

In the preparation of the release agent dispersion, after a release agent is dispersed in water with an ionic surfactant or a polymer electrolyte such as a polymer acid and a polymer base, heating is performed to a temperature higher than the melting temperature of the release agent, and a dispersion treatment is performed using a homogenizer or a pressure discharging type disperser by which a strong shearing force is imparted. Through the above treatment, the release agent dispersion is obtained. When performing the dispersion treatment, inorganic compounds such as polyaluminum chloride may be added to the dispersion. Examples of the preferable inorganic compound include polyaluminum chloride, aluminum sulfate, highly basic poly aluminum chloride (BAC), polyaluminum hydroxide, and aluminum chloride. Among these, polyaluminum chloride or aluminum sulfate is preferable. The above release agent dispersion is used in the emulsion aggregating method, and the above release agent dispersion may also be used when producing a toner by the suspension polymerization method.

By the dispersion treatment, a release agent dispersion including release agent particles having a volume average particle diameter of 1 μm or less is obtained. Moreover, a more preferable volume average particle diameter of the release agent particles is from 100 nm to 500 nm.

When the volume average particle diameter is 100 nm or greater, in general, the release agent component is likely to be incorporated in the toner, though this is also affected by the characteristics of the binder resin used. In addition, when the volume average particle diameter is 500 nm or less, the dispersion state of the release agent in the toner becomes good.

In the preparation of the colorant dispersion, it is possible to use known dispersion methods, and for example, it is possible to employ a generally used dispersing unit such as a rotary shearing type homogenizer, or those having media, such as a ball mill, a sand mill, a DYNO mill or an ULTIMIZER, however, there is no limitation thereto. The colorant is dispersed with an ionic surfactant or a polymer electrolyte such as a polymer acid, or a polymer base in water. The volume average particle diameter of the colorant particles dispersed in water may be 1 μm or less, and when the volume average particle diameter is in the range of from 80 nm to 500 nm, aggregability is not impaired and dispersing of the colorant in the toner is good, and thus, it is preferable.

Aggregation Step

In the aggregation step, a dispersion of resin particles, the colorant dispersion, the release agent dispersion, and the like are mixed to make a mixed solution, and the mixed solution is heated at a temperature below the glass transition temperature of the resin particles to aggregate, whereby aggregated particles are formed. In many cases, the aggregated particles are formed by adjusting the pH of the mixed solution to acidic while stirring. As the pH, the range of from 2 to 7 is preferable, and at this time, the use of a coagulant is also effective.

Moreover, in the aggregation step, the release agent dispersion may be added and mixed at once together with various dispersions such as a resin particle dispersion and the like, or may be added in divided portions.

As the coagulant, a surfactant having opposite polarity to that of the surfactant used as the above-described dispersant, inorganic metal salts, and a divalent or higher valent metal complex may be suitably used. In particular, in the case of using the metal complex, it is possible to reduce the amount of surfactant used and improve the charging characteristics, and thus, it is particularly preferable.

As the inorganic metal salts, in particular, aluminum salts and polymers thereof are suitable. In order to obtain a narrower particle diameter distribution, as the valence of the inorganic metal salt, a divalent inorganic metal salt is better than a monovalent inorganic metal salt, a trivalent inorganic metal salt is better than a divalent inorganic metal salt, and a tetravalent inorganic metal salt is better than a trivalent inorganic metal salt, and even if the valence is the same, a polymer-type inorganic metal salt polymer is more suitable.

In the exemplary embodiment, it is preferable to use a polymer of a tetravalent inorganic metal salt including aluminum in order to obtain a narrower particle diameter distribution.

In addition, by additionally adding (coating step) a dispersion obtained by dispersing the inorganic particles together with a surfactant when the diameter of the aggregated particles becomes a desired particle diameter, a toner having a configuration in which the inorganic particles are present on the surface of the core aggregation particle is obtained, and the inorganic particles are present in a state of being embedded into the surface of a toner particle and being exposed.

In addition, by additionally adding (coating step) a mixed dispersion of the inorganic particles and the resin particles instead of the dispersion of the inorganic particles in the same manner as described above, a shell layer including the inorganic particles and the resin may be formed on the toner particle surface, and the inorganic particles are present in a state of being embedded into the surface of a toner particle and being exposed.

When additional addition is performed, a coagulant may be added or pH adjustment may be performed before the additional addition.

Coalescing Step

In the coalescing step, by increasing the pH of the suspension of the aggregated particles to the range of from 3 to 9 under the stirring conditions according to the aggregation step, the progress of the aggregation is stopped, and by heating to a temperature above the glass transition temperature of the resin, the aggregated particles are coalesced. In addition, in a case where the aggregated particles are coated with the resin, the resin is also coalesced, and the core aggregation particles are coated. The heating may be performed until coalescence occurs, and the heating time may be from about 0.5 hours to about 10 hours.

By cooling after coalescing, coalesced particles are obtained. In addition, in the cooling step, crystallization may be promoted by dropping the cooling rate near the glass transition temperature of the resin (in a range of the glass transition temperature±10° C.), that is, performing a so-called slow cooling.

The coalesced particles obtained by coalescing are made to be toner particles through a solid-liquid separation step such as filtration, a washing step, and a drying step.

As the drying step, for example, a method using an airflow drying apparatus is exemplified, and examples thereof may include a drying treatment using a flash jet dryer and a treatment by a fluid bed. In particular, in the case of the drying treatment using a flash jet dryer, the airflow temperature (inlet airflow temperature) is preferably set to from 30° C. to 70° C. (more preferably from 40° C. to 60° C.)

Externally Adding Step

The obtained toner particles may be subjected to an addition treatment of an external additive such as a fluidizer or an auxiliary agent. As the external additive, known particles described above are used.

For example, the treatment may be performed by a V-blender, a HENSCHEL mixer, a LoDIGE mixer, or the like, and the attachment may be performed by dividing into several stages. By externally adding the above component to the toner particles, the toner of the exemplary embodiment is obtained.

Dissolution and Suspension Method

The dissolution and suspension method in the exemplary embodiment may have an oil phase preparation step of preparing an oil phase by dissolving or dispersing a toner component including at least a binder resin and a colorant in an organic solvent, a granulation step of suspending and granulating the oil phase component in an aqueous phase, and a solvent removal step of removing the solvent.

Moreover, in the exemplary embodiment, the inorganic particles are made to be present in a state of being embedded into the surface of a toner particle and being exposed. Thus, toner particles in which inorganic particles are present on the surfaces are obtained by mixing inorganic particles (preferably, hydrophilic inorganic particles) in a mixture of a binder resin and solvents (oil phase) to be dispersed in water together with a dispersant, by emulsifying the resultant product in water, and then, by removing the solvent while fixing the inorganic particles to the toner particle surfaces during removing the solvent (solvent removal step).

In addition, toner particles in which inorganic particles are present on the surfaces thereof are also obtained by using inorganic particles such as calcium carbonate particles or calcium phosphate particles as a dispersant used in a water phase in the dissolution and suspension method, by removing the solvent and by adjusting the amount of acid added.

Oil Phase Preparing Step

In the dissolution and suspension method, first, an oil phase is prepared by dissolving or dispersing a toner component including at least the above-described binder resin and colorant in an organic solvent.

In the exemplary embodiment, as the above-described binder resin, the above-described baroplastic resin is preferably used.

Although the organic solvent capable of being used varies depending on the type of the binder resin, in general, hydrocarbons such as toluene, xylene, and hexane, halogenated hydrocarbons such as methylene chloride, chloroform, and dichloroethane, alcohols or ethers such as ethanol, butanol, benzyl alcohol ether, and tetrahydrofuran, esters such as methyl acetate, ethyl acetate, butyl acetate, and isopropyl acetate, and ketones such as acetone, methyl ethyl ketone, diisobutyl ketone, cyclohexanone, and methylcyclohexane may be used. These solvents are required to dissolve the binder resin; however, may not dissolve the colorant and other additives. The weight ratio between the toner components such as the binder resin and the colorant used in the oil phase and the solvent preferably from 10:90 to 80:20 from the viewpoint of easy granulation or a final toner yield.

In the exemplary embodiment, it is preferable that before preparing an oil phase, a colorant dispersion is prepared by dispersing a colorant by a synergist and a dispersant in advance, and this is mixed with a binder resin or the like. When preparing the colorant dispersion, first, the synergist and the dispersant are attached to the colorant. Attachment to the colorant is performed using a usual stirrer. Specifically, for example, a method in which a colorant, a synergist, and a dispersant are put into a container provided with a granular medium such as an attritor, a ball mill, a sand mill, or a vibration mill, and the container is held within a preferable temperature range, for example, a temperature range of from 20° C. to 160° C., and stirring is performed is used. As the granular medium, steel such as stainless steel or carbon steel, alumina, zirconia, silica, or the like is preferably used. The colorant is disaggregated using the stirrer, then, the colorant is dispersed until the average particle diameter of the colorant becomes preferably 0.5 μm or less, and more preferably 0.3 μm or less, and by applying a load of stirring, the synergist and the dispersant are attached to the colorant. This is diluted with a solvent, whereby a colorant dispersion is obtained.

In addition, in the exemplary embodiment, when mixing the colorant dispersion, the binder resin, and the like, it is preferable to disperse again by high speed shearing or the like such that the coloring agent is not aggregated. Dispersing may be performed by a disperser provided with a high speed blade rotation type or a forcibly interval passing type high speed shearing mechanism such as a homomixer, a homogenizer, a colloid mill, ULTRA-TURRAX, or CLEARMIX (manufactured by M Technique Co., Ltd.). When preparing the oil phase liquid, the colorant is preferably dispersed in an oil phase liquid to have a particle diameter of preferably 1 μm or less, more preferably 0.5 μm or less, and still more preferably 0.3 μm or less.

Granulation Step

Next, these oil phase components are suspended and granulated so as to have a particle diameter required in an aqueous phase. Moreover, a chief medium of the aqueous phase is water, the inorganic particles (preferably, hydrophilic inorganic particles) are preferably further mixed with a dispersant, and inorganic particles such as calcium carbonate or calcium phosphate may be used as the dispersant.

The dispersant (dispersion stabilizer) functions to disperse and stabilize oil phase liquid droplets by forming a hydrophilic colloid. Examples of the inorganic dispersant include calcium carbonate, magnesium carbonate, barium carbonate, tricalcium phosphate, hydroxyapatite, silica diatomaceous earth, and clay. The particle diameter of the inorganic dispersant preferably from 0.01 μm to 2 μm, and more preferably 0.5 μm or less, and the inorganic dispersant is preferably used after being pulverized to have a required particle diameter using a wet type disperser such as a ball mill, a sand mill, or an attritor. When the particle diameter of these inorganic dispersants is 2 μm or less, the particle diameter distribution of the toner granulated is narrowed, and this is suitable for a toner, and thus, this is preferable.

Specific examples of the organic dispersant which may be used alone or in combination with the inorganic dispersant include gelatins and gelatin derivatives (for example, acetylated gelatin, phthalated gelatin, and succinated gelatin), proteins such as albumin and casein, collodion, gum arabic, agar, alginic acid, and cellulose derivatives (for example, alkyl esters of carboxymethyl cellulose, hydroxy methyl cellulose, and carboxymethyl cellulose), and synthetic polymers (for example, polyvinyl alcohol, polyvinyl pyrrolidone, polyacrylamide, a polyacrylic acid salt, a polymethacrylic acid salt, a polymaleic acid salt, and polystyrene sulfonic acid salt). These organic dispersants may be used alone or in combination of two or more types thereof.

The dispersant is preferably used in the range of from 0.001% by weight to 5% by weight with respect to the chief medium of the aqueous phase.

The aqueous phase may be used in combination with a dispersion assistant. As the dispersion assistant, a surfactant is suitable, and examples thereof include ionic surfactants and nonionic surfactants. These dispersion assistants may be used alone or in combination of two or more types thereof. The dispersion assistant is preferably used in the range of from 0.001% by weight to 5% by weight with respect to the chief medium of the aqueous phase.

Although the mixing ratio of the oil phase to the aqueous phase varies depending on the particle diameter of a final toner or the preparation apparatus, the mixing ratio of the oil phase to the aqueous phase is preferably from 10/90 to 90/10 in the weight ratio. In addition, granulation of the oil phase in the aqueous phase is preferably performed under high speed shearing. In particular, in a case where the particles of the toner are made to have a diameter in the range of from 2 μm to 10 μm, it is preferable that the disperser provided with a high speed shearing mechanism used is carefully selected. Among these, a high speed blade rotation type or a forcibly interval passing type emulsifying disperser such as a homomixer, a homogenizer, a colloid mill, ULTRA-TURRAX, or CLEARMIX (manufactured by M. Technique Co., Ltd.) is suitable.

Solvent Removal Step

The solvent is removed during or after the granulation step. Removal of the solvent may be performed at ordinary temperature (for examples, 25° C.), or may be performed under reduced pressure. In order to perform the removal at ordinary temperature, it is preferable that the temperature lower than the boiling point of the solvent, and suitable inconsideration of Tg of the resin is applied. When the temperature is significantly higher than Tg of the resin, the toner unification may occur. Stirring is preferably performed at about 40° C. for from 3 hours to 24 hours. When performing pressure reduction, the pressure is preferably reduced at from 20 mmHg to 150 mmHg.

Moreover, it is preferable to obtain toner particles in which the inorganic particles are present on the surfaces by fixing the inorganic particles to the toner particle surfaces during removal of the solvent, and specifically, it is preferable that by using hydrophilic inorganic particles, the removal of the solvent is performed while moving the inorganic particles to the toner particle surfaces due to the hydrophilicity during removal of the solvent.

The obtained granulated material (slurry material) is preferably washed with an acid which makes the inorganic dispersant water-soluble, such as hydrochloric acid, nitric acid, formic acid, or acetic acid after removing the solvent. Thus, the inorganic dispersant remaining on the toner surface is removed. The above acid or the alkali-treated granulated material may be washed again with alkaline water such as an aqueous sodium hydroxide solution. Thus, a part of the ionic materials on the toner surface insolubilized by being kept in an acidic atmosphere is solubilized and removed again, and thus, charging properties or powder fluidity is improved. Washing with an acid and alkaline water in this manner has an effect of washing and removing the wax separated from or attached to the surface of the toner. When using a stirrer or an ultrasonic dispersing apparatus in addition to the conditions such as pH at the time of washing, the number of washing, the temperature at the time of washing, and the like, washing is effectively performed, and thus, this is more preferable. Thereafter, a step such as filtration, decantation, or centrifugation may be performed, and after drying, toner particles are obtained.

As the drying, for example, a method using an airflow drying apparatus is exemplified, and examples thereof may include a drying treatment using a flash jet dryer and a treatment by a fluid bed. In particular, the airflow temperature in the drying treatment using a flash jet drier is the same as described above.

Electrostatic Charge Image Developer

The electrostatic charge image developer according to the exemplary embodiment includes at least the toner according to the exemplary embodiment.

The electrostatic charge image developer according to the exemplary embodiment may be a single-component developer including only the toner according to the exemplary embodiment, or a two-component developer obtained by mixing the toner with a carrier.

The carrier is not particularly limited, and known carriers are exemplified. Examples of the carrier include a coated carrier in which surfaces of cores formed of a magnetic powder are coated with a coating resin; a magnetic powder dispersion-type carrier in which a magnetic powder is dispersed and blended in a matrix resin; and a resin impregnation-type carrier in which a porous magnetic powder is impregnated with a resin.

Moreover, the magnetic powder dispersion-type carrier and the resin impregnation-type carrier may be carriers in which constituent particles of the carrier are cores and have a surface coated with a coating resin.

Examples of the magnetic powder include magnetic metals such as iron, nickel, and cobalt, and magnetic oxides such as ferrite and magnetite.

Examples of the conductive particles include particles of metals such as gold, silver, and copper, carbon black particles, titanium oxide particles, zinc oxide particles, tin oxide particles, barium sulfate particles, aluminum borate particles, and potassium titanate particles.

Examples of the coating resin and the matrix resin include polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylic acid copolymer, a straight silicone resin configured to include an organosiloxane bond or a modified product thereof, a fluorine resin, polyester, polycarbonate, a phenol resin, and an epoxy resin.

Moreover, the coating resin and the matrix resin may include other additives such as a conductive material.

Herein, a coating method using a coating layer forming solution in which a coating resin and, if necessary, various additives are dissolved in a suitable solvent is used to coat the surface of a core with the coating resin. The solvent is not particularly limited, and may be selected in consideration of the type of coating resin to be used, coating suitability, and the like.

Specific examples of the resin coating method include a dipping method of dipping cores in a coating layer forming solution; a spraying method of spraying a coating layer forming solution to surfaces of cores; a fluid bed method of spraying a coating layer forming solution in a state in which cores are allowed to float by flowing air; and a kneader-coater method in which cores of a carrier and a coating layer forming solution are mixed with each other in a kneader-coater and the solvent is removed.

The mixing ratio (weight ratio) between the toner and the carrier in the two-component developer is preferably from 1:100 to 30:100, and more preferably from 3:100 to 20:100 (toner:carrier).

Image Forming Method and Image Forming Apparatus

The image forming apparatus according to the exemplary embodiment is provided with an image holding member, a charging unit that charges a surface of the image holding member, an electrostatic charge image forming unit that forms an electrostatic charge image on a charged surface of the image holding member, a developing unit that accommodates the electrostatic charge image developer according to the exemplary embodiment and develops the electrostatic charge image formed on the surface of the image holding member with the electrostatic charge image developer to form a toner image, a transfer unit that transfers the toner image formed on the surface of the image holding member onto a surface of a recording medium, and a fixing unit that fixes the toner image transferred onto the surface of the recording medium by applying pressure.

The image forming method according to the exemplary embodiment has a charging step that charges a surface of the image holding member, an electrostatic charge image forming step that forms an electrostatic charge image on a charged surface of the image holding member, a developing step that develops the electrostatic charge image formed on the surface of the image holding member with the electrostatic charge image developer according to the exemplary embodiment to form a toner image, a transfer step that transfers the toner image formed on the surface of the image holding member onto a surface of a recording medium, and a fixing step that fixes the toner image transferred onto the surface of the recording medium by applying pressure.

Moreover, in the fixing unit and the fixing step, the toner image transferred onto the surface of the recording medium is preferably fixed by applying pressure from 1 Mpa to 10 MPa as a maximum pressure.

Any one of the steps and units described above may be performed by a known method or unit which is employed in the image forming method and the image forming apparatus in the related art. In addition, in the exemplary embodiment, in the case of further using an intermediate transfer member, the toner image formed on the image holding member surface is transferred once to the intermediate transfer member, and finally, transferred to a recording medium, and the toner image transferred to the recording medium surface is fixed.

Furthermore, the image forming apparatus and the image forming method may include a unit or a step other than the units or the steps described above, for example, such as a cleaning unit or a cleaning step for cleaning an image holding member surface, or the like.

In the case of using an electrophotographic photoreceptor as the image holding member, for example, it is possible to perform image formation in the following manner. First, the surface of an electrophotographic photoreceptor is charged using a corotron charger, a contact charger, or the like, and exposed to light, whereby an electrostatic charge image is formed. Next, the electrostatic charge image is brought into contact with or approached to a developing roll in which a developer layer is formed on the surface, and due to this, toner particles are attached to the electrostatic charge image, whereby a toner image is formed on the electrophotographic photoreceptor. The formed toner image is transferred onto the surface of a recording medium such as paper using a corotron charger or the like. Furthermore, the toner image transferred onto the surface of a recording medium is fixed by a fixing device, whereby an image is formed on the recording medium.

Moreover, as the electrophotographic photoreceptor, in general, an inorganic photoreceptor such as amorphous silicon or selenium, or an organic photoreceptor using polysilane, phthalocyanine, or the like as a charge generating material or a charge transport material may be used, and, in particular, an amorphous silicon photoreceptor is preferable since it has a long lifetime.

Fixing Step and Fixing Unit

In the exemplary embodiment, the fixing step is performed by applying pressure without heating. In addition, the fixing unit does not have a heating unit.

The maximum pressure of the fixing pressure is preferably 1 MPa to 10 MPa, more preferably 2 MPa to 8 MPa, and still more preferably 3 MPa to 7 MPa.

When the pressure (fixing pressure) at the time of fixing is 1 MPa or greater, sufficient fixability is obtained, and thus, this is preferable. In addition, when the pressure is 10 MPa or less, image stains, fixing roll contamination, or an occurrence of paper winding due to an occurrence of offset is decreased, and problems such as paper bending (referred to as paper curling) after fixing is unlikely to occur, and thus, this is preferable.

As the fixing roll, a fixing roll selected from known fixing rolls in the related art may be used in the range in which the above fixing pressure may be applied.

For example, a fixing roll coated with a fluorine resin (for example, TEFLON (registered trademark)), a silicone resin, or a perfluoroalkylate on a cylindrical core metal is exemplified, and in order to obtain a high fixing pressure, a fixing roll made of SUS may be also used. In general, the fixing step is performed by passing a recording medium between two rolls, and the two rolls may be formed of the same material, or may be formed of different materials. For example, combinations such as SUS/SUS, SUS/silicone resin, SUS/PFA, PFA/PFA, and the like are exemplified.

The pressure distribution between the fixing roll and a pressure roll may be measured by a commercially available pressure distribution measurement sensor, and specifically, the pressure distribution may be measured by a pressure measurement system between rollers manufactured by Kamata Industry Co., Ltd. In the exemplary embodiment, the maximum pressure at the time of pressure-fixing refers to a maximum value in pressure change from a fixing nip entrance to an outlet in the paper traveling direction.

In the exemplary embodiment, the fixing step is performed without heating. Here, performing fixing without heating means that there is no heating unit which directly heats the fixing unit. Therefore, it is not prevented that the temperature in the apparatus becomes the environmental temperature or higher by heat or the like generated by other powers.

The fixing temperature is preferably from 15° C. to 50° C., more preferably from 15° C. to 45° C., and still more preferably from 15° C. to 40° C.

When the fixing temperature is in the above range, it is preferable since good fixability may be obtained.

Cleaning Step and Cleaning Unit

The image forming method of the exemplary embodiment further has a cleaning step of cleaning the toner remaining on the surface of the image holding member after the transfer step. Moreover, although a method of cleaning the residual toner using a generally used cleaning blade may be employed, the cleaning step is more preferably a brush cleaning step of cleaning the residual toner by using a brush. In addition, the image forming apparatus of the exemplary embodiment preferably has a cleaning unit, and the cleaning unit is more preferably a brush cleaning unit.

A brush cleaning system in which the stress on the individual toner is small is suitable for cleaning of the transfer residual toner on a photoreceptor. In addition, auxiliarily, an elastic blade in a state in which the applying pressure is lowered may be used; however, cleaning is preferably performed mainly using a brush.

In general, cleaning of the toner remaining on the surface of the image holding member is performed using a cleaning blade or a cleaning brush. In the exemplary embodiment, the residual toner is preferably cleaned using a cleaning brush.

The brush cleaning step is preferable since the pressure applied to the residual toner is small, and attachment to the photoreceptor is unlikely to occur. On the other hand, in the case of blade cleaning, by stress from the cleaning blade, the residual toner is fluidized and attached to the photoreceptor, and due to this, filming or the like occurs, in some case.

The brush cleaning unit used in the exemplary embodiment is a toner removing member having a brush member, and the brush may take the form corresponding to the purpose, for example, a fixed brush such as a brush or a rotating brush in which fiber is disposed in a cylindrical shape and is rotated in use thereof. In addition, it is also possible to use a conductive brush which is used for applying a voltage using a conductive fiber.

Examples of the fiber of the brush include a natural cellulose fiber and regenerated cellulose fibers such as rayon, a nylon fiber, a polypropylene fiber, a polyester fiber, a polyurethane fiber, a polyolefin fiber, an acrylic fiber, a polyamide fiber, a polyamide imide fiber, a polyether amide fiber, a polyphenylene sulfide fiber, a polybenzimidazole fiber, and a polyvinyl fiber, but not limited thereto.

In addition, carbon black, a metal oxide powder, a metal powder, a conductive resin, or the like may be mixed in these fibers in order to impart conductivity. A toner scraping member may be disposed on the brush of the toner removing member as necessary, and one or plural toner removing members per image holding member may be disposed as necessary. As a particularly preferable form, a form in which the toner removing member in which a conductive fiber is disposed in a cylindrical shape to be adjacent to the image holding member is provided, the toner removing member is provided with a flicker bar which flicks the toner from the brush fiber to be adjacent thereto, and a toner collection container for accommodating the toner flicked out is provide may be exemplified.

Figure 2:
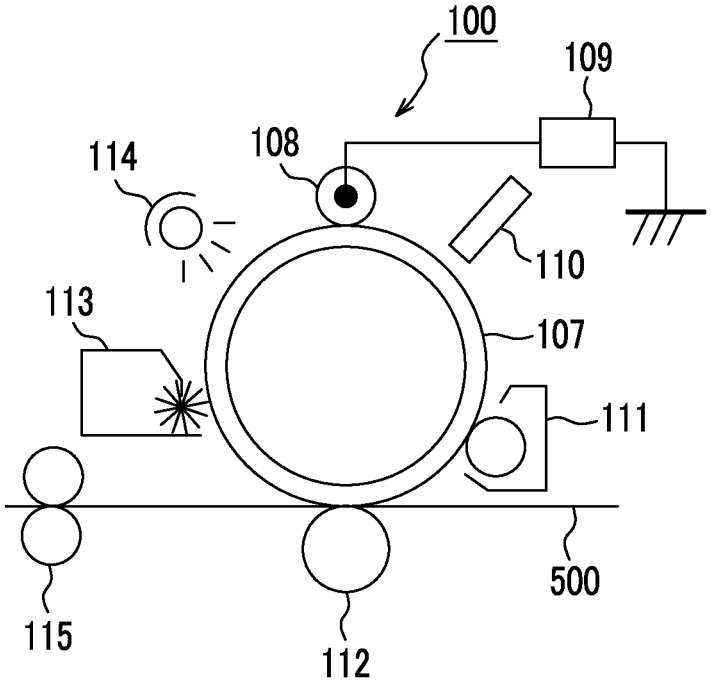
FIG. 2 is a sectional view schematically showing a basic configuration of an exemplary embodiment of an image forming apparatus capable of performing an image forming method according to the exemplary embodiment.

FIG. 2 is a sectional view schematically showing a basic configuration of a suitable exemplary embodiment of the image forming apparatus capable of performing the image forming method according to the exemplary embodiment. An image forming apparatus 100 shown in FIG. 2 is provided with an electrophotographic photoreceptor (image holding member) 107, a charging device 108 such as a charging roll for charging the electrophotographic photoreceptor 107, a power source 109 connected to the charging device 108, an exposure device (electrostatic charge image forming unit) 110 for forming an electrostatic charge image by exposing the electrophotographic photoreceptor 107 charged by the charging device 108, a developing device (developing unit) 111 for developing the electrostatic charge image formed by the exposure device 110 by a developer to form a toner image, a transfer device (transfer unit) 112 for transferring a toner image formed by the developing device 111 to a recording medium 500, a cleaning device 113 for removing the toner remaining on the electrophotographic photoreceptor 107 after transferring, an erasing device 114, and a fixing device (fixing unit) 115.

Here, the cleaning device 113 in FIG. 2 is a brush cleaning device, and removes the toner remaining on the electrophotographic photoreceptor 107 using a brush member. In addition, the fixing device 115 is a pressure-fixing device, and does not have a heating unit.

As each device on the image forming apparatus 100, any device which is employed in an image forming apparatus in the related art may be applied.

Moreover, the image forming apparatus in the exemplary embodiment may not have the erasing device 114. In addition, although a contact type charging device is shown in FIG. 2 as the charging device 108, the charging device 108 may be a non-contact type charging device such as a corotron charger.

Recording Medium

In the exemplary embodiment, any recording medium may use used. In the exemplary embodiment, as a recording medium, a transfer sheet having a formation index of 20 or greater is preferably used. The formation index is more preferably 23 or greater, and still more preferably 25 or greater.

Regarding to the transfer sheet, to achieve a good fixability in the image on the sheet, reduction of the formation irregularities is important. As the formation irregularities are decreased, distribution of the pressure when the toner is pressure-fixed to the sheet is reduced, and even a toner having a small diameter may be favorably fixed, and thus, both good image quality and pressure fixability may be achieved.

Since the transfer sheet having a formation index of 20 or greater has small formation irregularities, both good image quality and pressure fixability may be achieved, and thus, the transfer sheet is preferable.

Here, the formation index is measured by the following method.

A 3D sheet analyzer (M/K950) manufactured by M/K Systems, Inc. (MKS Inc.) is used, the diameter of the aperture of the analyzer is set to 1.5 mm, and the formation index is measured by using a micro formation tester (MFT). That is, a sample is installed on a drum which rotates in the 3D sheet analyzer, and by a light source installed on the drum shaft and a photodetector installed in correspondence with the light source on the outside of the drum, a localized basis weight difference in the sample is measured as a light quantity difference. The measurement target range at this time is set by the diameter of the aperture installed on the light input portion of the photodetector. Next, the light quantity difference (deviation) is amplified, A/D-conversion is performed, classification is performed into 64 light measurement basis weight classes, 1,000,000 pieces of data are taken in a single scan, and a histogram frequency of the data portion is obtained. Furthermore, the highest frequency (peak value) of the histogram is divided by the number of classes having the frequency of 100 or greater among those classified into the classes corresponding to 64 minute basis weights, and this resultant value is multiplied by $1/100$, whereby the formation index is obtained. The formation index FI is represented by the following equation.

$$FI=((\text{peak value(frequency)})/(\text{number of classes having frequency of 100 or greater}))\times(1/100)$$

A transfer sheet having a great formation index has less irregularities in paper quality, and the formation is good.

As a method for reducing the formation irregularities of a transfer sheet which is a fixing medium, there are a method of providing a screen or a vortex flow cleaner of a base paper just before a head box of a paper machine, and thereby adjusting the flow direction of the original material not to be constant, or of controlling flocculation of the original material using a known additive chemical such as guar gum, locust bean gum, mannogalactan, deacetylated karaya gum, alginate, carboxymethyl cellulose, methylcellulose, or hydroxyethyl cellulose, and the like, but the examples thereof are not limited thereto.

In addition, it is also possible to reduce the formation irregularities by providing a coating layer on a base paper. The coating layer in a coated paper is formed in order to increase smoothness, uniformity, opacity, and whiteness of the transfer sheet, reinforce strength, and increase the image formation suitability of a transfer sheet. The coating layer is configured of mainly a pigment, a pigment dispersant, and a binder resin. As the pigment, kaolin clay, delaminated clay, Georgia clay, China clay, calcium carbonate, satin white, titanium oxide, aluminum hydroxide, or the like is used. As the pigment dispersant, sodium pyrophosphate, sodium polyacrylate, sodium hexametaphosphate, sodium tripolyphosphate, styrene-maleic acid copolymer sodium, or the like is used. As the binder resin, polyvinyl alcohol, carboxymethyl cellulose, styrene-butadiene latex, various starches, casein, soybean protein, vinyl acetate latex, a vinyl acetate-dibutyl maleate copolymer, or the like is used.

Regarding coating with these, a pigment and a binder are dispersed and dissolved to prepare a solution, then, a transfer sheet is coated with the resultant solution using a roll coater, an air knife coater, a rod coater, a cast coater, or the like, and is subjected to a drying treatment using a infrared dryer, a drum dryer, an air cap dryer, an air foil dryer, an air conveyor dryer, or the like.

As to the average weight ratio, that of pigment is around 25%, and that of the binder resin is around 5%, whereas that of a base-sheet is 70%.

The transfer sheet used in the image forming method of the exemplary embodiment is typically formed by using wood pulp as a main raw material, and a loading material is mixed in the transfer sheet. The loading material used here is a white loading material such as a heavy or light calcium carbonate, talc, kaolin, clay, titanium dioxide, zeolite, or white carbon, and among these, calcium carbonate is preferable since coloring properties of the color material is good. The loading material is mixed preferably in the range of from 5% by weight to 30% by weight, and more preferably in the range of from 10% by weight to 25% by weight to increase the voids of a transfer sheet, and improve the opacity. When the mixing amount is 30% by weight or less, the strength of the transfer sheet is increased, and paper powder is unlikely to occur, and thus, this is preferable.

Next, a toner cartridge according to the exemplary embodiment will be described.

The toner cartridge according to the exemplary embodiment is a toner cartridge which accommodates the electrostatic charge image developing toner according to the exemplary embodiment and is detachable from the image forming apparatus.

EXAMPLES

Hereinafter, the exemplary embodiment will be more specifically described with reference to Examples and Comparative Examples, but the exemplary embodiment is not limited to the following Examples. Moreover, "part(s)" and "%" are based on weight unless specified otherwise.

Example 1

Preparation of Toner by Emulsion Aggregating Method

Resin Particle Dispersion (1): Preparation of High Tg Resin

Styrene 450 parts
n-Butyl acrylate 150 parts
Acrylic acid 12 parts
Dodecanethiol 9 parts The above components are mixed and dissolved to prepare a solution.

20 parts of an anionic surfactant (manufactured by Dow Chemical Company, DOWFAX 2A1) is dissolved in 250 parts of ion exchange water, the above-prepared solution is added thereto, and the resultant is dispersed and emulsified in a flask to prepare an emulsion (monomer emulsion A).

Furthermore, 3 parts of an anionic surfactant (manufactured by Dow Chemical Company, DOWFAX 2A1) is dissolved in 555 parts of ion exchange water, and the resultant product is put into a flask for polymerization.

The flask for polymerization is sealed hermetically, a reflux tube is provided thereto, and the flask for polymerization is heated to 75° C. in a water bath while introducing nitrogen and slowly stirring and kept.

9 parts of ammonium persulfate is dissolved in 43 parts of ion exchange water, then, the resultant product is added dropwise to the flask for polymerization over 20 minutes through a metering pump, and the monomer emulsion A is added dropwise thereto over 200 minutes through a metering pump.

Thereafter, the flask for polymerization is kept at 75° C. for 3 hours while slowly and continuously stirring, and then the polymerization is stopped.

Thus, a resin particle dispersion (1), in which the center diameter of the particles is 75 nm, the glass transition temperature is 51° C., the weight average molecular weight is 29,000, and the solid content is 42%, is obtained.

Resin Particle Dispersion (2): Preparation of Low Tg Resin

Styrene 100 parts
n-Butyl acrylate 500 parts
Acrylic acid 12 parts
Dodecanethiol: 9 parts The above components are mixed and dissolved to prepare a solution.

20 parts of an anionic surfactant (manufactured by Dow Chemical Company, DOWFAX 2A1) is dissolved in 250 parts of ion exchange water, the above-prepared solution is added thereto, and the resultant is dispersed and emulsified in a flask to prepare an emulsion (monomer emulsion B).

Furthermore, 3 parts of an anionic surfactant (manufactured by Dow Chemical Company, DOWFAX 2A1) is dissolved in 555 parts of ion exchange water, and the resultant product is put into a flask for polymerization.

The flask for polymerization is sealed hermetically, a reflux tube is provided thereto, and the flask for polymerization is heated to 75° C. in a water bath while injecting nitrogen and slowly stirring and kept.

9 parts of ammonium persulfate is dissolved in 43 parts of ion exchange water, then, the resultant product is added dropwise to the flask for polymerization over 20 minutes through a metering pump, and the monomer emulsion B is added dropwise thereto over 200 minutes through a metering pump.

Thereafter, the flask for polymerization is kept at 75° C. for 3 hours while slowly and continuously stirring, and then the polymerization is stopped.

Thus, a resin particle dispersion (2), in which the center diameter of the particles is 50 nm, the glass transition temperature is 10° C., the weight average molecular weight is 26,000, and the solid content is 42%, is obtained.

Preparation of Colorant Particle Dispersion (P1)

Cyan pigment (manufactured by Dainichiseika Color & Chemicals Mfg. Co., Ltd, copper phthalocyanine C. I. Pigment Blue 15:3) 50 parts Anionic surfactant (manufactured by DKS Co., Ltd., NEOGEN RK) 5 parts Ion exchange water 200 parts The above components are mixed and dissolved, and the resultant product is dispersed for 5 minutes using a homogenizer (manufactured by IKA Works, Inc., ULTRA-TURRAX) and for 10 minutes in an ultrasonic bath, whereby a cyan colorant particle dispersion (P1) in which the center diameter is 190 nm and the solid content is 21.5% is obtained.

Preparation of Inorganic Particle Dispersion (I1)

RX50 (manufactured by Nippon Aerosil Co., Ltd., silica) 100 parts

Anionic surfactant (manufactured by DKS Co., Ltd., NEOGEN RK) 5 parts

Ion exchange water 200 parts

The same treatment as the treatment for dispersing the pigment is performed, whereby an inorganic particle dispersion (I1) is obtained.

Preparation of Toner Particles

Resin particle dispersion (1) 100 parts (high Tg resin 42 parts)

Resin particle dispersion (2) 100 parts (low Tg resin 42 parts)

Colorant particle dispersion (P1) 40 parts (pigment 8.6 parts)

Poly aluminum chloride 0.15 parts

Ion exchange water 300 parts

According to the above mixing proportion, the components are sufficiently mixed and dispersed in a stainless round flask using a homogenizer (manufactured by IKA Works, Inc., ULTRA-TURRAX T50), then, the resultant product is heated to 42° C. while being stirred in a heating oil bath, and kept at 42° C. for 60 minutes, subsequently, 40 parts (RX50: 13 parts) of the inorganic particle dispersion (I1) is additionally added thereto, and the resultant product is slowly stirred.

Thereafter, the pH in the system is adjusted to 5.5 with a 0.5 mol/L sodium hydroxide aqueous solution, and the resultant product is heated to 90° C. while being continuously stirred. While being heated to 90° C., usually, the pH in the system is lowered to 4.5 or less, but, here, the sodium hydroxide aqueous solution is additionally added dropwise such that the pH does not become 5.0 or less.

After the dropping ends, the resultant product is cooled, filtered, and sufficiently washed with ion exchange water, and solid-liquid separation is performed by Nutsche type suction filtration. Furthermore, the resultant product is redispersed in ion exchange water at 40° C., then, stirred for 15 minutes at 100 rpm using a stainless steel impeller, and washed. After this washing operation is repeated three times, solid-liquid separation is performed by a Nutsche type suction filtration, then, the water content is adjusted to 40%, and drying is performed using a flash jet dryer of which the inlet airflow temperature is set to 60° C.

When measuring particle diameters of the toner particles using a COULTER MULTISIZER II (manufactured by Beckman Coulter, Inc.), the cumulative volume average particle diameter D50 is 4.7 μm, and the volume average particle diameter distribution index GSDv is 1.23.

The % by volume (20 μm-over amount) of particles having a diameter of 20 μm or greater, which is an indicator of the amount of coarse powder, is only 1.2% by volume, and this is the same level as in a usual thermal fixing toner.

In addition, the shape factor SF1 of the toner particles obtained by observing the shape with LUZEX is 130.

When performing the surface observation using a scanning electron microscope, appearance in which the toner surfaces are uniformly coated with silica (RX50), and each particle is uniformly fixed (in a state of being embedded into the surface and being exposed) is observed.

In addition, when the amount (weight ratio) of silica in the toner is determined by fluorescent X-ray analysis, it is found that the amount is 13% by weight, and almost all of the incorporated silica is included in the surface of the toner.

With respect to the toner (toner before adding hydrophobic silica (manufactured by Cabot Corporation, TS720) described below), the BET specific surface area measured by the method described above are shown in the following Table 1.

In addition, when measuring temperature difference ΔT ($T_1$–$T_{10}$) of the toner, it is found that the temperature difference is 40° C., and enough baroplastic characteristics are exhibited.

Preparation of Developer 1.5 parts of hydrophobic silica (manufactured by Cabot Corporation, TS720) is added to 50 parts of the above toner, and the resultant product is mixed with a sample mill, whereby an externally added toner is obtained.

Furthermore, in using a ferrite carrier having an volume average particle diameter of 35 μm coated with 1% by weight of polymethyl methacrylate (Mw: 70,000, manufactured by Soken Chemical & Engineering Co., Ltd.), the externally added toner is weighed such that the toner concentration becomes 8%, and the externally added toner and the ferrite carrier both are stirred and mixed for 5 minutes with a ball mill, whereby a developer is prepared.

Image Evaluation (fixability)

The above developer is used, and in a modified machine of a DOCUCENTER COLOR f450 manufactured by Fuji Xerox Co., Ltd., the fixing machine is modified to a two-roll type fixing machine such that the maximum fixing pressure becomes 5 MPa (50 kgf/cm$^2$), an A4 size C2 sheet manufactured by Fuji Xerox Co., Ltd. as a transfer sheet is used without heating, the toner weight per unit area of a solid image is adjusted to 4 g/m$^2$, and the toner solid image coverage in the A4 sheet is set to 60%, and the sheet is passed through in the longitudinal direction.

When examining the fixability of the toner by scraping using cloth, stains of the cloth or deficiency of the image is not observed, and thus, the fixability is good.

Example 2

Preparation of Toner by Dissolution and Suspension Method

Preparation of Resin (3)

Resin particle dispersion (1) described above: 60 parts of high Tg resin latex

2-Ethylhexyl acrylate low Tg latex (manufactured by DIC Corporation, CE6400, Tg of about −40° C.) 40 parts The above components are mixed, and water is removed by a hot-air dryer, whereby a resin (3) is obtained.

It is observed that the resin (3) becomes untransparent and opaque after drying, and is phase-separated in micro size.

Preparation of Toner Solution

Resin (3) 95 parts

Cyan pigment (manufactured by Dainichiseika Color & Chemicals Mfg. Co., Ltd, C. I. Pigment Blue 15:3) 5 parts THF (tetrahydrofuran) 300 parts Ethyl acetate 300 parts The above components are mixed, and the resultant product is dispersed for 3 hours using a ball mill with zirconia balls.

Preparation of Calcium Carbonate Dispersion

Calcium carbonate (manufactured by Maruo Calcium Co., Ltd., LUMINOUS) 200 parts

Anionic surfactant (manufactured by DKS Co., Ltd., NEOGEN RK) 5 parts

Ion exchange water 400 parts

The above components are mixed, and the resultant product is dispersed for 2 hours using a ball mill with zirconia balls.

900 parts of ion exchange water is further added thereto, and the resultant product is mixed using a homogenizer.

The toner solution is added to the calcium carbonate dispersion while operating a homogenizer to perform uniform emulsification. Thereafter, the solvent is removed over 4 hours while heating to 40° C. Furthermore, after most of calcium carbonate is dissolved by adding 300 parts of 1 N hydrochloric acid thereto, the resultant product is passed through a 15 μm nylon mesh, filtered, and sufficiently washed with ion exchange water, and solid-liquid separation is performed by Nutsche type suction filtration. Furthermore, the resultant product is redispersed in ion exchange water at 40° C., then, stirred for 15 minutes at 100 rpm using a stainless steel impeller, and washed. After this washing operation is repeated three times, solid-liquid separation is performed by Nutsche type suction filtration, then, the water content is adjusted to 40%, and drying is performed using a flash jet dryer of which the inlet airflow temperature is set to 60° C.

When measuring particle diameters of the toner particles, the cumulative volume average particle diameter D50 is 5.5 μm, and the volume average particle diameter distribution index GSDv is 1.25.

The % by volume (20 μm-over amount) of toner particles having a diameter of 20 μm or greater, which is an indicator of the amount of coarse powder, is only 1.6% by volume, and this is the same level as in a usual thermal fixing toner.

In addition, the shape factor SF1 of the toner particles obtained by observing the shape is 126.

When performing the surface observation using a scanning electron microscope, appearance in which the toner surfaces are uniformly coated with calcium carbonate, and each particle is uniformly fixed (in a state of being embedded into the surface and being exposed) is observed.

In addition, when the amount (weight ratio) of calcium in the toner is determined by fluorescent X-ray analysis, it is found that the amount is 9% by weight, and almost all of the incorporated silica is included in the surface of the toner.

The BET specific surface area measured with respect to the toner (toner before adding hydrophobic silica (manufactured by Cabot Corporation, TS720) described above) by the method described above are shown in the following Table 1.

In addition, when measuring temperature difference ΔT ($T_1$–$T_{10}$) of the toner, it is found that the temperature difference is 45° C., and enough baroplastic characteristics are exhibited.

Comparative Example 1

A toner is prepared without adding the inorganic particle dispersion (I1) used in Example 1.

The 20 μm-over amount is 6.8% by volume.

Example 3

A toner is prepared by using one third of the amount of inorganic particle dispersion (I1) used in Example 1.

The 20 μm-over amount is 2.7% by volume.

Comparative Example 2

A toner is prepared by using one third of the amount of 1 N hydrochloric acid used in Example 2.

The 20 μm-over amount is 1.1% by volume, and the amount of calcium carbonate quantified is 24%, and when measuring of the temperature difference ΔT ($T_1$–$T_{10}$) of the toner, the temperature difference is 18° C.

Example 4

A toner is prepared by using one half of the amount of 1 N hydrochloric acid used in Example 2.

The 20 μm-over amount is 0.8% by volume, and the amount of calcium carbonate quantified is 18.0%, and when measuring the temperature difference ΔT ($T_1$–$T_{10}$) of the toner, the temperature difference is 25° C., and baroplastic characteristics are exhibited.

Comparative Example 3

Silica (RX50) corresponding to 15% by weight with respect to the toner solid content is added to the toner particles including water before adjusting the water content to 40% after preparing the toner particles in accordance with Comparative Example 1, and the resultant product is mixed. Thereafter, the water content is adjusted to 40% in the same manner as in Comparative Example 1, and drying is performed using a flash jet dryer of which the inlet airflow temperature is set to 60° C., whereby a toner is prepared.

The 20 μm-over amount is 5.5% by volume. In SEM observation of the toner particles after drying, separated-aggregated silica is observed, and after the ultrasonic treatment, it is observed that most of the silica is eliminated.

For the toner, the BET specific surface area is measured by the method described above. In addition, regarding the toner in Comparative Example 3, the silica which is attached to the surface (which is separated) is removed by performing an ultrasonic treatment (20 KHz, 10 minutes) on, and then the BET specific surface area is measured again. The results are shown in Table 1 below.

TABLE 1

| | $T_1$-$T_{10}$ [° C.] | Inorganic particles Type | Embedding and exposing | Weight ratio [%] | BET specific surface area [$m^2$/g] | BET specific surface area [$m^2$/g] (after an ultrasonic treatment) | Evaluation D50 v [μm] | GSDv | 20 μm -over amount [% by volume] | Image evaluation (fixability) |
|---|---|---|---|---|---|---|---|---|---|---|
| Example 1 | 40 | Silica | Present | 15 | 2.4 | — | 4.7 | 1.23 | 1.2 | stain and defect absent |
| Example 2 | 45 | Calcium carbonate | Present | 9 | 1.8 | — | 5.5 | 1.25 | 1.6 | Stain and defect absent |
| Example 3 | 40 | Silica | Present | 5.5 | 1.6 | — | 6.0 | 1.26 | 2.7 | Stain and defect absent |
| Example 4 | 25 | Calcium carbonate | Present | 18.0 | 3.0 | — | 5.8 | 1.26 | 0.8 | Stain and defect absent |
| Comparative Example 1 | 40 | Absent | — | — | 1.4 | — | 5.9 | 1.40 | 6.8 | Stain absent, defect present |
| Comparative Example 2 | 18 | Calcium carbonate | Present | 24 | 4.5 | — | 5.4 | 1.27 | 1.1 | Stain present, defect absent |
| Comparative Example 3 | 40 | Silica | Absent (separated) | 15 | 6.0 | 1.4 | 6.5 | 1.35 | 5.5 | Stain absent, defect present |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic charge image developing toner comprising:

toner particles containing a binder resin and inorganic particles that are present in a state of being embedded into the surfaces of the toner particles and being exposed, and the toner particles satisfy the following expression:

$$20° \text{ C.} \leq T_1 - T_{10}$$

wherein $T_1$ represents the temperature at which the viscosity under an applied pressure of 1 MPa becomes $10^4$ Pa·s, and $T_{10}$ represents the temperature at which the viscosity under an applied pressure of 10 MPa becomes $10^4$ Pa·s, and a BET specific surface area of the toner articles is in a range of from 0.8 $m^2$/g to 5.0 $m^2$/g.

2. The electrostatic charge image developing toner according to claim 1, wherein a weight ratio of the inorganic particles contained in the toner particles is in a range of from 5% by weight to 20% by weight.

3. The electrostatic charge image developing toner according to claim 1, wherein the toner particles satisfy the following expression:

$$20° \text{ C.} \leq T_1 - T_{10} \leq 120° \text{ C.}$$

4. The electrostatic charge image developing toner according to claim 1, wherein the toner particles satisfy the following expression:

$$40° \text{ C.} \leq T_1 - T_{10} \leq 100° \text{ C.}$$

5. The electrostatic charge image developing toner according to claim 1, wherein the toner particles contain two or more kinds of resins as the binder resin.

6. The electrostatic charge image developing toner according to claim 5, wherein the toner particles contain at least two binder resins having different glass transition temperatures which are different by 30° C. or greater.

7. The electrostatic charge image developing toner according to claim 1, wherein the toner particles contain particles having a particle diameter of 20 μm or greater in an amount of 3% by volume or less based on the entirety of the toner particles.

8. The electrostatic charge image developing toner according to claim 1, wherein a volume average particle diameter of the inorganic particles is in a range of from 0.05 μm to 0.2 μm.

9. An electrostatic charge image developer comprising:

the electrostatic charge image developing toner according to claim 1; and a carrier.

10. The electrostatic charge image developer according to claim 9, wherein a weight ratio of the inorganic particles contained in the toner particles of the electrostatic charge image developing toner is in a range of from 5% by weight to 20% by weight.

11. A toner cartridge, which accommodates the electrostatic charge image developing toner according to claim 1 and is detachable from an image forming apparatus.

12. The toner cartridge according to claim 11, wherein a weight ratio of the inorganic particles contained in the toner particles of the electrostatic charge image developing toner is in a range of from 5% by weight to 20% by weight.

* * * * *